US007138216B2

(12) United States Patent
Yamazaki et al.

(10) Patent No.: US 7,138,216 B2
(45) Date of Patent: Nov. 21, 2006

(54) IMAGE FORMING METHOD EMPLOYING THE TONER

(75) Inventors: Hiroshi Yamazaki, Hachioji (JP); Meizo Shirose, Hachioji (JP); Masafumi Uchida, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 205 days.

(21) Appl. No.: 10/818,901

(22) Filed: Apr. 5, 2004

(65) Prior Publication Data

US 2004/0265726 A1 Dec. 30, 2004

(30) Foreign Application Priority Data

Apr. 11, 2003 (JP) ..... 2003-107561

(51) Int. Cl.
*G03G 13/14* (2006.01)

(52) U.S. Cl. ..... 430/126; 430/120; 430/110.1; 430/108.4

(58) Field of Classification Search ..... 430/126, 430/120, 110.1, 108.4
See application file for complete search history.

(56) References Cited

U.S. PATENT DOCUMENTS

2002/0136976 A1 9/2002 Ohmura et al.
2003/0194629 A1* 10/2003 Ohira et al. ..... 430/110.1

FOREIGN PATENT DOCUMENTS

JP 2001-100546 4/2001
JP 2001-117381 4/2001
JP 2002-214821 7/2001

* cited by examiner

*Primary Examiner*—Mark A. Chapman
(74) *Attorney, Agent, or Firm*—Lucas & Mercanti, LLP

(57) ABSTRACT

An image forming method comprising the step of transferring a toner image while applying vibration by ultrasonic wave where in the toner particle forming the toner image has a sea-island structure containing at least two islands of a releasing agent, and the average of the nearest distance between the islands is from approximately 100 nm to approximately 1060 nm and the number of the island having the nearest wall distance of not less than 1300 nm is not more than 10% of the whole number of the islands contained in the toner particle.

20 Claims, 6 Drawing Sheets

IMAGE FORMING METHOD EMPLOYING THE TONER

BACKGROUND

1. Technical Field

The present invention relates to an image forming method in which a toner image formed by a toner is transferred utilizing ultrasonic vibration, particularly related to formation of a color image formed by plural color toners, and to an image forming method employing a toner in which the dispersed state of a releasing agent is controlled to a specific condition.

2. Related Art

Recently, digital method becomes as the main stream of the image formation by the electrophotographic system. One of such the trends of the technology is a technology of full color image formation. One of the techniques to accelerate the colorization of the toner image is a full color image forming method employing an oil less toner containing a large amount of a releasing agent in the toner particle (cf. Japanese Patent Publication Open to Public Inspection, hereinafter referred to as Japanese Patent O.P.I. Publication, No. 2002-214821, paragraph [0049],). In the digital image formation, small size toner having micron order of diameter is required for visualizing a small dot image, for example, on a level of 1200 dpi (dot number per inch, 1 inch is 2.54 cm).

In such the image formation employing the small diameter toner, the transfer ability is degraded on the occasion of transfer of the image formed on the photoreceptor onto an image receiving material such as paper and OHP film. Particularly, in the formation of color image by accumulating color toners of Y, M and C, such the tendency becomes considerable and the transfer of the toner image from the photoreceptor surface or an intermediate transfer member is become instable and not reliable. Consequently, suitable color balance and the density are difficultly obtained in the color image formed on the image receiving material. Therefore, techniques have been investigated for surely transferring the toner image onto the image receiving material by applying a physical action to the photoreceptor. As one of such the measures, it is known that ultrasonic waves are applied to the carrier carrying the toner on the occasion of transference of the toner image onto the image receiving material so as to efficiently transfer the toner image from the carrier surface onto the image receiving material by the vibration of the ultrasonic waves (cf. for example, Japanese Patent O.P.I. Publication Nos. 2002-100546, paragraph [0052]–[0061] and 2001-117381, paragraph [0035] and [0062]).

However, the toner transfer methods employing ultrasonic waves disclosed in Japanese Patent O.P.I. Publication Nos. 2002-100546 and 2001-117381 are methods which have been developed for the toner which is employed while coating oil on the image receiving material on the occasion of fixing. And then results expected by the inventors cannot be obtained when the above method is applied to an image forming method employing oil-less toner.

When the transference of the oil-less toner is performed while applying the ultrasonic waves, the releasing agent is released from the toner particle by the influence of the ultrasonic waves, and then winding of the image receiving material about the fixing roller and offset are resulted.

An external additive of the oil-less toner is also released from the toner together with the releasing agent and increasing of the adhering force of the toner with the photoreceptor is resulted. Consequently, toner particles lowered in the transferring ratio are formed. And then the toner image is tend to be deformed by the vibration of the ultrasonic waves, and a problem is resulted that the toner images each having different color from each other cannot be exactly overlapped.

The invention is accomplished according to the above situation. The object of the invention is to provide an image forming method without occurrence of the winding the image receiving material about the fixing roller and the offset by employing a toner from which the releasing agent is not released when the ultrasonic waves are applied.

The invention is to provide an image forming method in which the toner image is not deformed even when the vibration of the ultrasonic waves are applied and the toner images can be exactly overlapped to form a full color image.

SUMMARY

An image forming method employing ultrasonic wave vibrations on the occasion of transference of the toner image, in which a toner particle constituting the toner has a sea-island structure including plural islands of a releasing agent, and the average nearest wall distance between the islands in the toner particle is from approximately 100 to approximately 1060 nm, and the ratio of islands each having the nearest wall distance is not less than 1,300 nm is not more than 10% in number. The toner image may be a toner image formed by overlapping plural toner images each different in the color thereof.

BRIEF DESCRIPTION OF THE DRAWINGS

The present invention will become more fully understood from the detailed description given herein below and the accompanying drawings which are given by way of illustration only, and thus are not intended as a definition of the limits of the present invention, and wherein;

FIG. 1(*b*) is an illustration which describes the concept of the nearest wall distance.

DETAILED DESCRIPTION OF EXEMPLARY EMBODIMENTS

Figure 1:
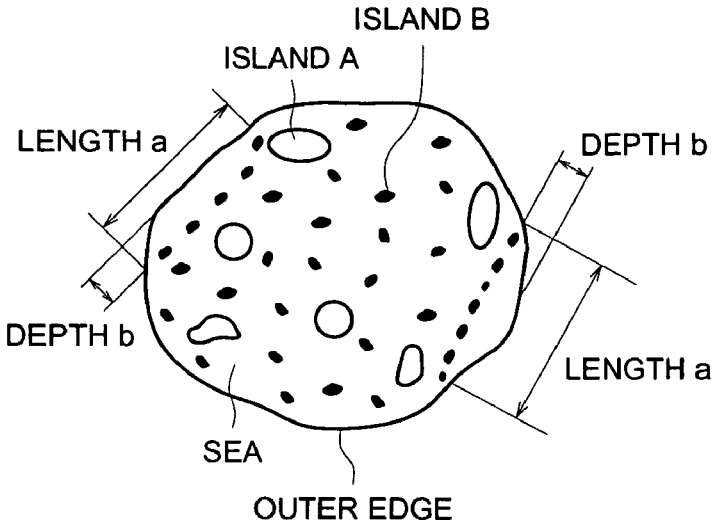
FIG. 1(*a*) is a schematic illustration of an example of a toner particle having the sea-island structure.
Figure 1:
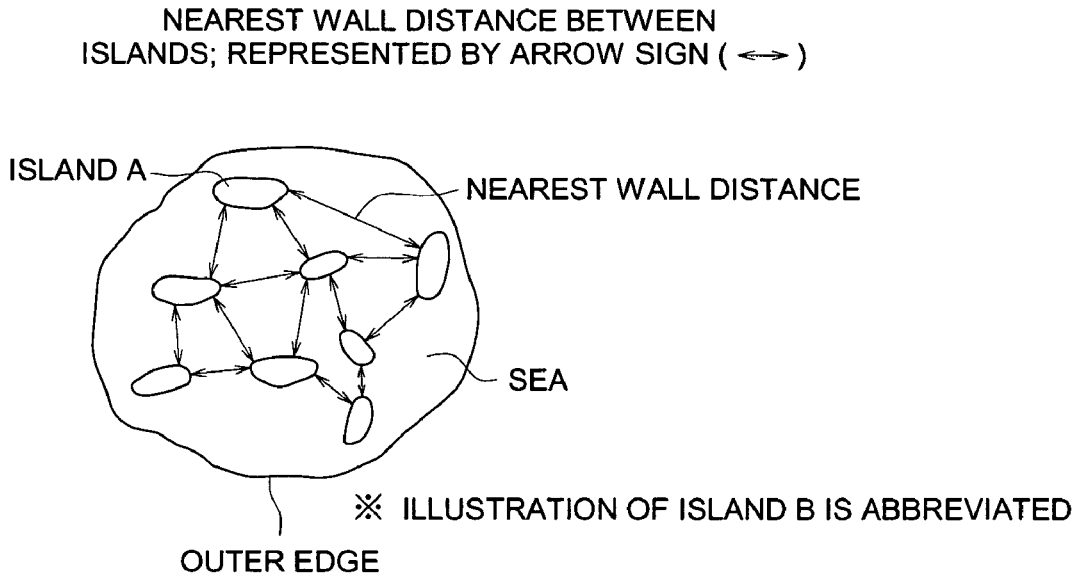

It is supposed by the inventors that the releasing agent phase in the toner particle tends to preferentially and selectively absorbs the vibration when the ultrasonic vibration is applied so that the releasing agent phase particularly concentrated and locally receives the influence of the ultrasonic vibration and is released from the particle.

Therefore, the inventors have investigated to control the distribution state of the releasing agent in the toner particle so that the releasing agent phase in the toner particle does not locally receive the ultrasonic vibration to prevent the concentration of the influence of the ultrasonic vibration to the releasing agent. As a result of the investigation, it has been found that the winding of the image receiving material carrying the toner image about the fixing roller and the offset do not occur and good full color toner image can be obtained, in which the toner images of each colors are correctly overlapped without deformation of the image when the image formation is performed by processing includes the transfer by the ultrasonic vibration and employing a toner satisfying the following conditions.

It has been found by the inventors that the suitable fixing ability can be realized and image formation without deformation of the image can be obtained when the image formation is carried out by the processing including the transfer process by ultrasonic vibration and employing the toner containing the releasing agent and having the sea-island structure.

It is confirmed that the visualization of the dot image of 1,200 dpi is possible by the image formation through the transfer process by ultrasonic vibration employing the toner within the range of from 2 to 7 μm, and it is found that the image formation of a digital image with high precision can be made possible.

The invention is described in detail below.

In the toner to be employed in the image forming method according to the invention, it is a peculiarity that the average value of the nearest wall distance is from 100 to 1,600 nm and the ratio of the island having the nearest wall distance of not less than 1,300 nm to the entire islands in the toner particle is not more than 10% by number.

In the toner particle, the islands of the releasing agent region regulated by the above conditions are uniformly and finely dispersed having a suitable distance. Accordingly, it is considered that the structure of the toner particle is made so that the influence of the vibration is not centralized in the course of the transfer process utilizing the ultrasonic waves, and the problem of the releasing of the releasing agent from the toner particle is solved.

Consequently, it is supposed that the winding of the image receiving paper about the fixing roller and the occurrence of offset are prevented by the toner in which the releasing agent is dispersed in the state satisfying the above conditions so as to be made possible the good image formation even when the image formation is carried out by the processing through the transfer process by the ultrasonic waves.

In the invention, the problem of that the releasing agent is released from the toner particle by the influence of the vibration is solved. Consequently, the deformation of the toner image on the transfer medium does not occur and the formation of the high quality full color image is made possible in which the toner images each having different colors are exactly overlapped.

It is confirmed by a transmittance electron microscopic photograph that the islands of the releasing agent are finely and uniformly dispersed in the toner particle according to the specific conditions defined as above.

The condition of that the average nearest wall distance is from 100 to 1,060 nm and the ratio of the islands each having the distance between the walls is not more than 10% in number of the whole islands contained in the toner particle means that the islands of the releasing agent exist with shorter cycle than that in a usual toner. In other word, the islands of the releasing agent are dispersed in the toner particle are uniformly without unevenness dispersed while maintaining a fine distance between each of them; the state of the dispersion is not mingled state of portions in which the islands are in excessively high density and portions in which almost no island exists.

FIG. 1 is a schematic illustration describing an example of the toner particle having the sea-island structure. In FIG. 1(*b*), the nearest wall distance between the islands of the releasing agent is shown by an arrow (↔).

The nearest wall distance of the islands in the toner particle means the distance between the interfaces of the adjacent islands of the releasing agent in the toner particle as shown by the arrow in the schematic illustration of FIG. 1.

In the invention, when the average nearest wall distance is from 260 to 820 nm and the ratio of the number of the island having the nearest wall distance becomes to not more than 4% of the whole number of islands in the toner particle, the tendency of that the influence of the vibration is equally given to both of the resin portion and the releasing agent portion is strengthen since the phase of the releasing agent is made further finely dispersed state. Accordingly, the state of the toner particle is made further stable.

The ratio of the number of the islands having the nearest wall distance not less than 1300 nm to the whole number of islands in the toner particle is near the 10%, variations in the stability of the image on the occasion of the transfer and in the offset property at the fixing are observed, but the variations do not influence on the image formation.

In the toner particle to be employed in the invention, the ratio of the number of the island having the nearest wall distance of not less than 1,300 nm may be 0%. The state of the ratio is 0% means that the islands of the releasing agent are dispersed each having suitable distance from each other and the distribution of the releasing agent is finely dispersed in the state entirely without unevenness.

The toner to be employed in the image forming method relating to the invention contains islands of colorant, other than the islands of the releasing agent, which can be distinguished from other islands by the difference of the brightness in the electron microphotograph; the islands of the colorant component is shown as island B in the schematic illustration of FIG. 1(*a*). As is cleared in the schematic illustration, plural kinds of island such as the island of the releasing agent and the island of colorant component may be contained in the toner particle having the sea-island structure according to the invention. These different kinds of the island can be easily distinguished on the electron microscopic photograph since the different kinds of the island are different in the brightness.

(Description of Toner Diameter)

The number average diameter of the toner particles is preferably from 2 to 7 μm and more preferably from 3 to 6 μm. The number average diameter of the toner particles can be controlled by varying the concentration and the timing of addition of an aggregation agent or salting out agent and the temperature in the production process.

Particularly, when the toner is a fine particle toner having a number average diameter of from 3.5 to 4.0 μm, the reproducibility of the fine line dot image is largely improved additionally to the foregoing and such the toner is made suitable for forming a digital image of 1,200 dpi level.

The concrete means for measuring the number average diameter of the toner is, for example, Coulter Counter TA-II and Coulter Multisizer, either manufactured by Coulter Co., Ltd., a sheath flow type granularity measuring apparatus SD2000 manufactured by Sysmex Co., Ltd., are employable. In the invention, the number average diameter of the toner particles are measured and calculated by employing Coulter Multisizer connected to a personal computer through an interface for outputting the particle diameter distribution, manufactured by Nikkaki Co., Ltd.

Next, an example of the image forming apparatus employable in the invention is described. In the invention, the toner image is transferred while applying ultrasonic vibration to form a full color image at the step of transferring the toner image formed on the image carrying member to the image receiving material, at the step of transferring in piles the toner image formed on the image carrying member to the intermediate transfer member or the step of transferring the piled toner images to the image receiving material.

Figure 2:
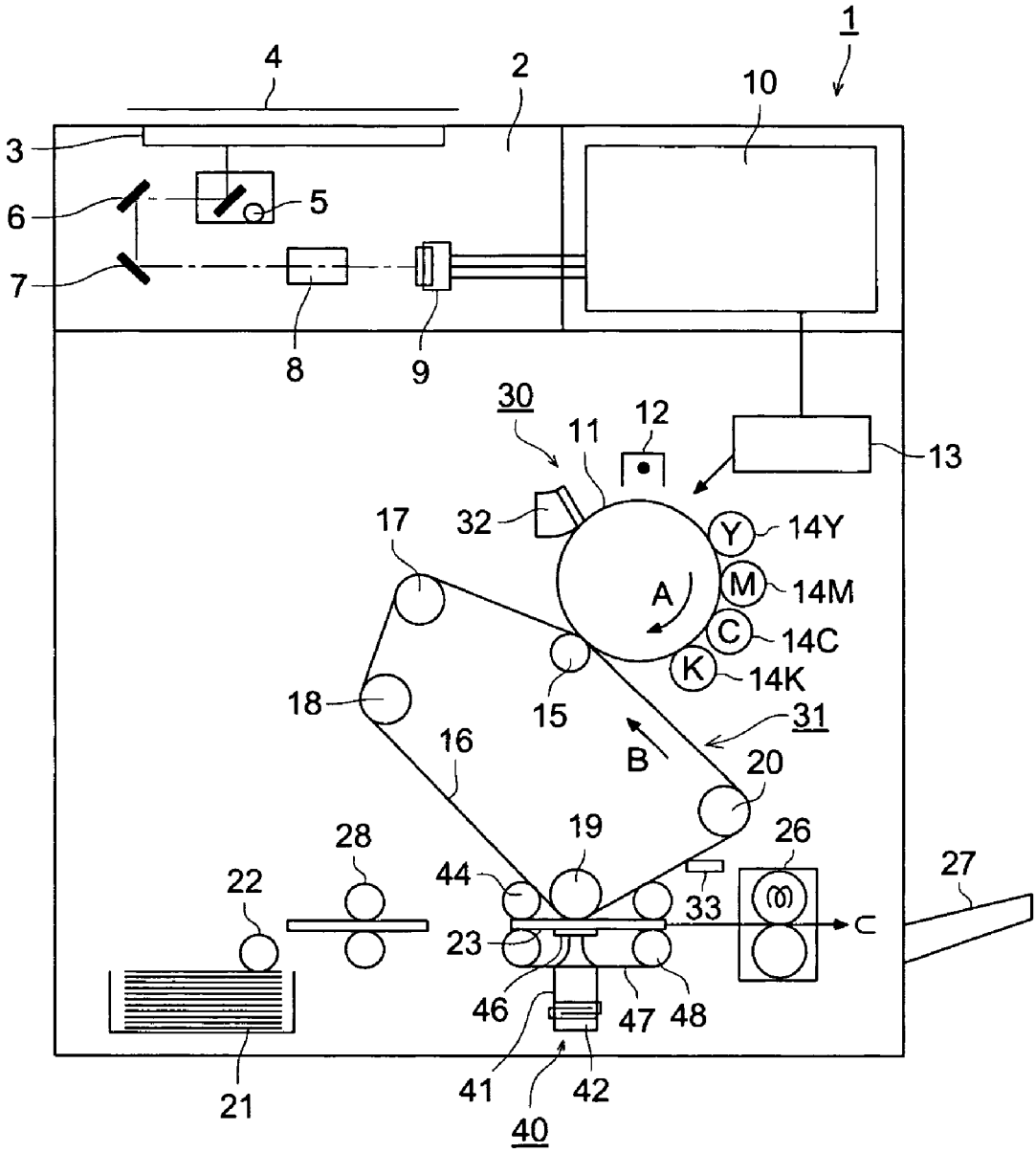
FIG. 2 is a schematic illustration showing an example of image forming apparatus to be preferably employed in the invention.

FIG. 2 is a schematic illustration showing an example of the image forming apparatus preferably employed in the invention.

Figure 3:
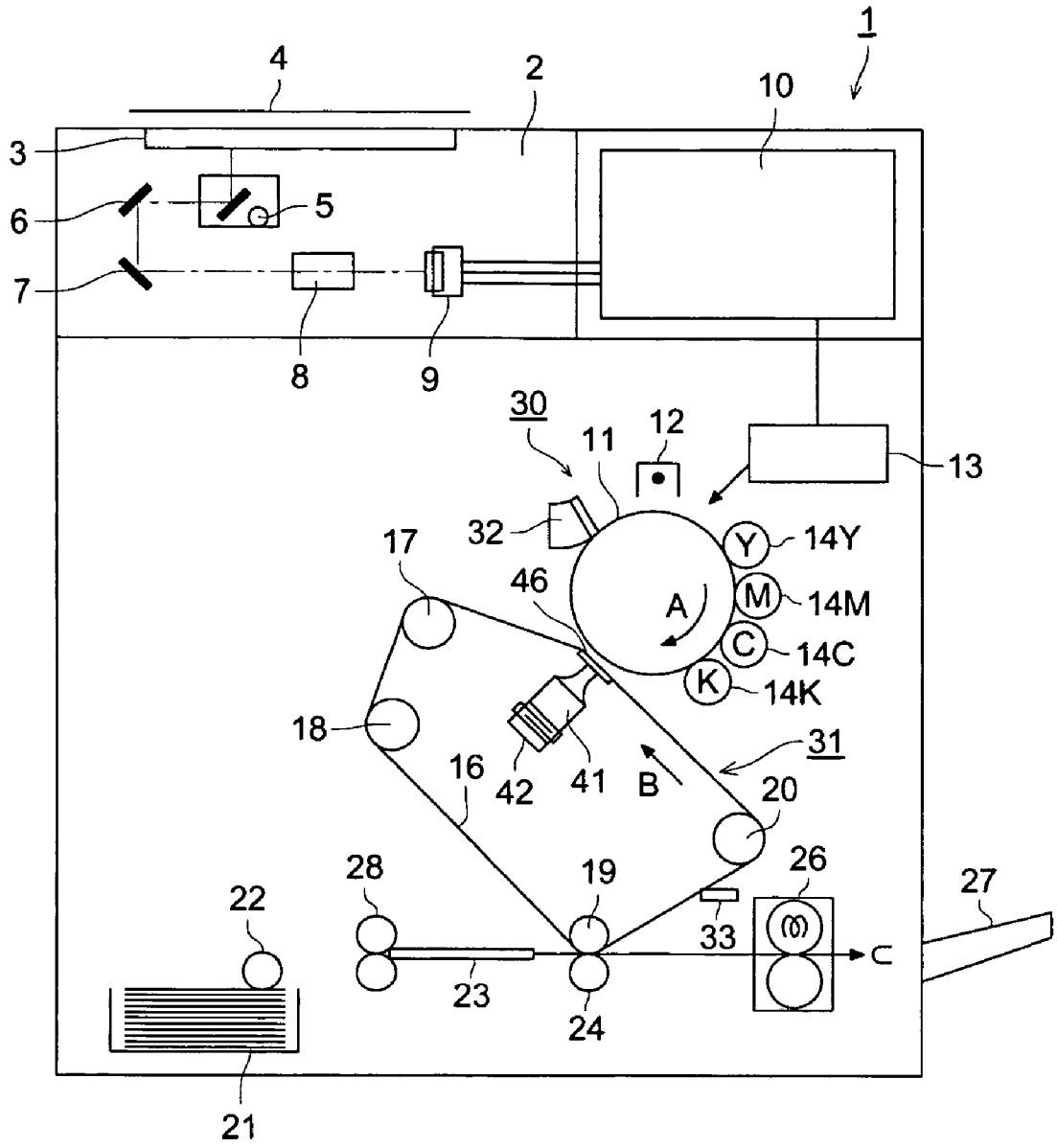
FIG. 3 is a schematic illustration showing an example of the image forming apparatus in which the toner image on the photoreceptor drum is transferred to an intermediate transfer member.

The image forming apparatus shown in FIG. 3 is an example of the constitution of apparatus preferably employed in the invention. The image forming apparatus has a drum-shaped photoreceptor 11 rotatable in the direction of arrow A, and an original reading means 2 for reading the image of original 4 is arranged at the upper portion of the body of the color forming apparatus 1. The image reading means has a platen glass 3, a light source 5, two scanning mirrors 6 and 7, a focusing lens 8 and a color CCD sensor 9.

In the body of the color image forming apparatus 1, an image forming unit 30, an intermediate transferring member unit 31 are arranged. In the image forming unit 30, a charging device 12 for almost uniformly charging the photoreceptor drum 11, a laser beam scanning device for writing a static latent image by irradiating a laser beam to the photoreceptor drum 11, and developing devices 14Y, 14M, 14C and 14K each containing a Yellow (Y), magenta (M), cyan (C) and black (Bk) toners, respectively, are arranged around the photoreceptor drum 11.

In the intermediate transfer unit, an intermediate transfer belt 16 is provided which is suspended by a driving roller 17, idling rollers 18 and 20, and a secondary transferring backup roller 19, and the intermediate transfer belt 16 is driven by a driving roller 17 so as to be circulated in the direction of arrow B.

At the lower portion of the body of the image forming apparatus 1, a paper supplying cassette containing paper 32, a conveying roller for picking up and conveying the paper 23 one by one, and a register roller 28 for conveying the paper 32 to the position facing to the intermediate transfer belt 16, are provided.

In FIG. 2, an ultrasonic wave generation element 42 and a horn 41 are arranged at the portion where the intermediate transfer belt 16 is faced to the image receiving material, and in FIG. 3 they are arranged at the back side of the intermediate transfer belt.

Moreover, a fixing device 26 for fixing the toner image transferred onto the paper and a tray 27 onto which the paper after fixing is output is provided.

Figure 5:
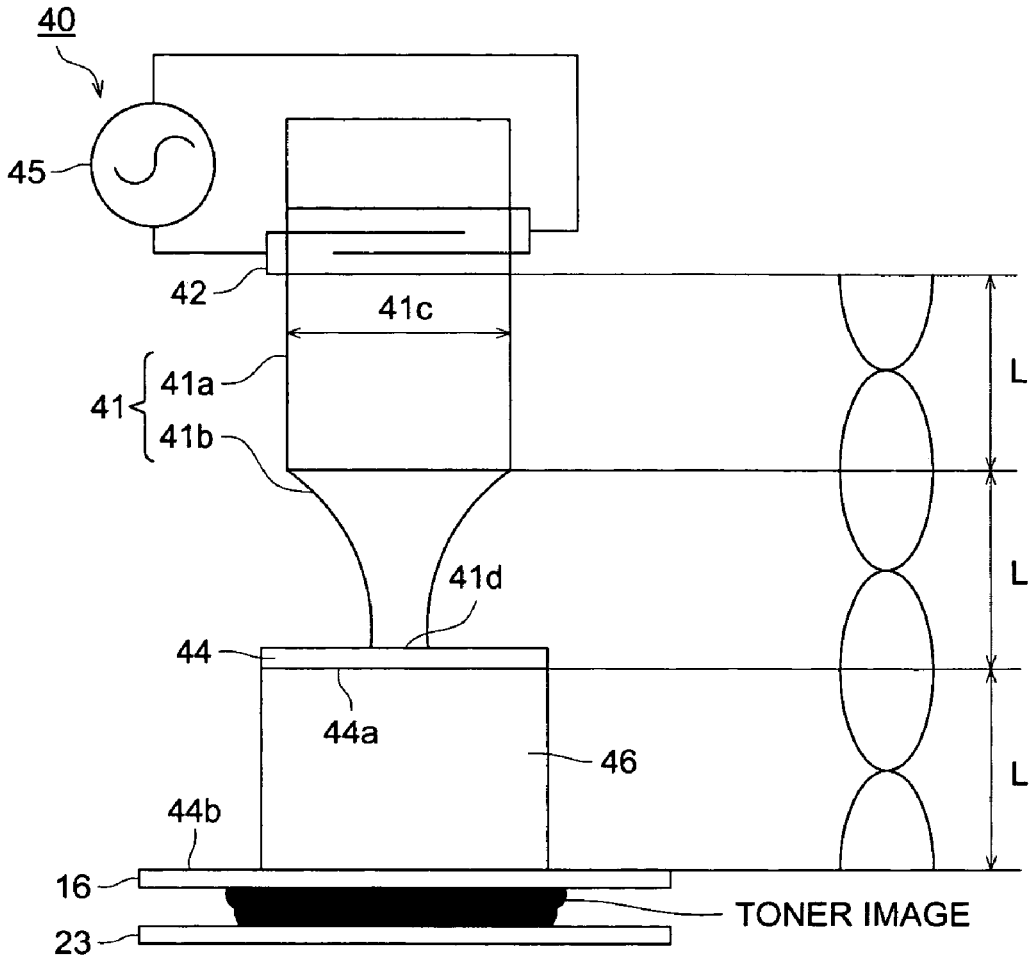
FIG. 5 is a schematic illustration of an example of ultrasonic wave apparatus employable in the invention.

FIG. 5 is a schematic illustration of a typical ultrasonic wave apparatus 40 to be employed in the invention. The ultrasonic wave apparatus 40 shown in FIG. 5 is constituted by an ultrasonic wave generation element 42, a horn 41 for introducing the generated ultrasonic waves to an ultrasonic wave irradiating face 44*a*, and a high frequency power source 45. The ultrasonic apparatus is not limited to it.

As the ultrasonic wave generation element 42, for example, a ceramic type piezoelectric element is employed for generating strong ultrasonic waves. The ultrasonic wave generation element 42 is strongly fixed by an organic adhering agent to a straight pipe portion 41*a* of the horn 41 composed of the strait pipe portion 41 and a horn portion 41*b*, each of which has a length L. The length L is integer times of ½ of the sonic wavelength of $\lambda_1$ defined by the resonance frequency of the ultrasonic wave generation element and the sonic speed in the material.

The horn portion 41*b* is formed as a bugle-like shape in which the cross section area thereof is made so as to be gradually smaller toward from the straight pipe portion 41*a* contacted with the ultrasonic generation element 42 to the end of the horn portion e1*b*. The material constituting the horn 41 is typically SUS, and aluminum bronze, phosphor bronze, a titanium alloy and duralmin are usable other than USU.

The vibration amplitude of the ultrasonic wave generation element 42 can be amplified corresponding to the ratio of the area of the irradiating face 41*c* of the straight pipe portion 41*a* to the area of the end face 41*d* so that further strong ultrasonic waves can be irradiated. Moreover, the fatigue or the degradation of the vibrating property caused by the vibration stress can be prevented by decreasing the vibration amplitude of the ultrasonic wave generation element 42.

In the invention, the ratio of the area of the irradiation end 41*c* of the horn 41 to the area of the end face are 5:1; it has been confirmed that the vibration efficiency of the horn 41 is most effectively realized when the area ratio is near such the ratio.

Moreover, in the ultrasonic apparatus 40, an ultrasonic irradiating plate 44 is attached. In FIG. 5, the ultrasonic irradiation plate has a disc shape having a diameter of 25 cm. An ultrasonic wave irradiating face 44*a* is formed at the face of the ultrasonic irradiation plate facing to the subject.

As above-mentioned, it is made possible by the ultrasonic wave apparatus 40 that the ultrasonic waves are generated by the ultrasonic wave generation element 42 and the vibration amplitude of the ultrasonic waves is amplified by the use of the horn 41 and irradiated from the ultrasonic wave irradiation face 44*a* having a large area so that strong energy vibration is given to a wide area of the subject.

In the invention, thus constituted ultrasonic wave apparatus 40 are arranged as a strait line or a staggered line in the cross direction of the intermediate transfer belt 16 to form the ultrasonic wave vibrations applying means.

It is confirmed that a frequency of from 40 kHz to 2 MHz is suitable in the invention. The frequency within such the range is preferred since the thickness of the ultrasonic wave generation element has to be thin and the output of the ultrasonic waves is difficultly made large when the frequency is made high.

Figure 6:
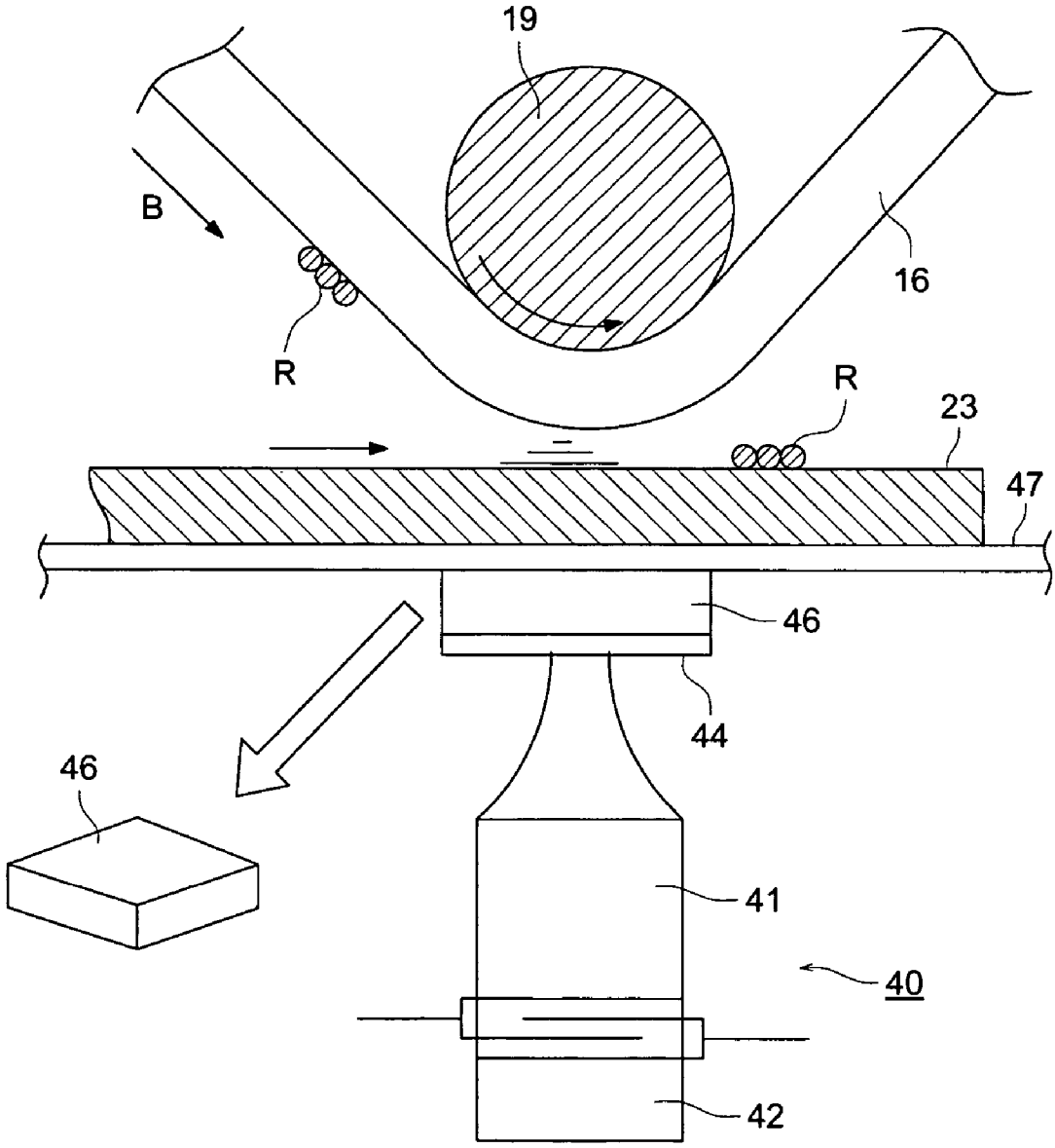
FIG. 6 is a schematic illustration showing the relative position of an intermediate transfer belt and image receiving material.

In the invention, it is preferable to provide a sheet-shaped gel member 46 as an ultrasonic wave conducting member as shown in FIGS. 5 and 6 inside of the intermediate transfer belt 16 or inside of the conveying belt 47 and the ultrasonic irradiation face for obtaining high transfer efficiency at the transferring position. Other than the sheet shaped gel member, the gel member 46 may be formed by coating a gel material with taking out from a tube on the ultrasonic wave irradiation plate 44.

In the invention, the ultrasonic waves can be certainly conducted to the intermediate transfer belt 16, so as to raise the transfer efficiency at the transferring position by providing the ultrasonic wave conductive member at the transferring position. Moreover, the ultrasonic wave conductive member prevents rubbing the end portion of the ultrasonic wave apparatus 40 with the intermediate transfer belt 16 or the conveying belt 47 so that the members constituting the apparatus can be protected.

As the gel member 46, for example, 100% silicone is employed and functioned as the ultrasonic wave conducting member on the occasion of the transfer. The gel member 46 most preferably employed in the invention is a sheet-shaped silicone type gel. The sheet-shaped silicone gel is preferable since the sheet-shaped gel can conduct the ultrasonic waves to the facing face 44 while the gel itself is almost not received the influence of pressure. The silicone type gel is superior in the resistivity to heat and chemicals, and the properties thereof are almost not varied accompanied with the passing of time. Therefore, the silicone type gel can stably hold the ultrasonic wave conducting ability for long period and do not contaminate the environment, and it is confirmed that the silicone gel is superior in hygienic and environmental suitability.

Concrete examples of the sheet-shaped silicone type gel include a silicone gel sheet composed of a silicone gel layer laminated on a silicone rubber layer, cf. Japanese Patent O.P.I. Publication No. 2-196453, a silicone gel sheet composed of a silicone gel layer laminated on a silicon rubber sheet which is composed of a mesh-shaped reinforcing material such as glass cloth covered with hardened silicone rubber, cf. Japanese Patent O.P.I. Publication No. 6-155517, and a silicone gel sheet having a metal foil on one side thereof, cf. 6-201226. It is confirmed that any types of silicone gel sheet can be employed in the invention.

Figure 4:
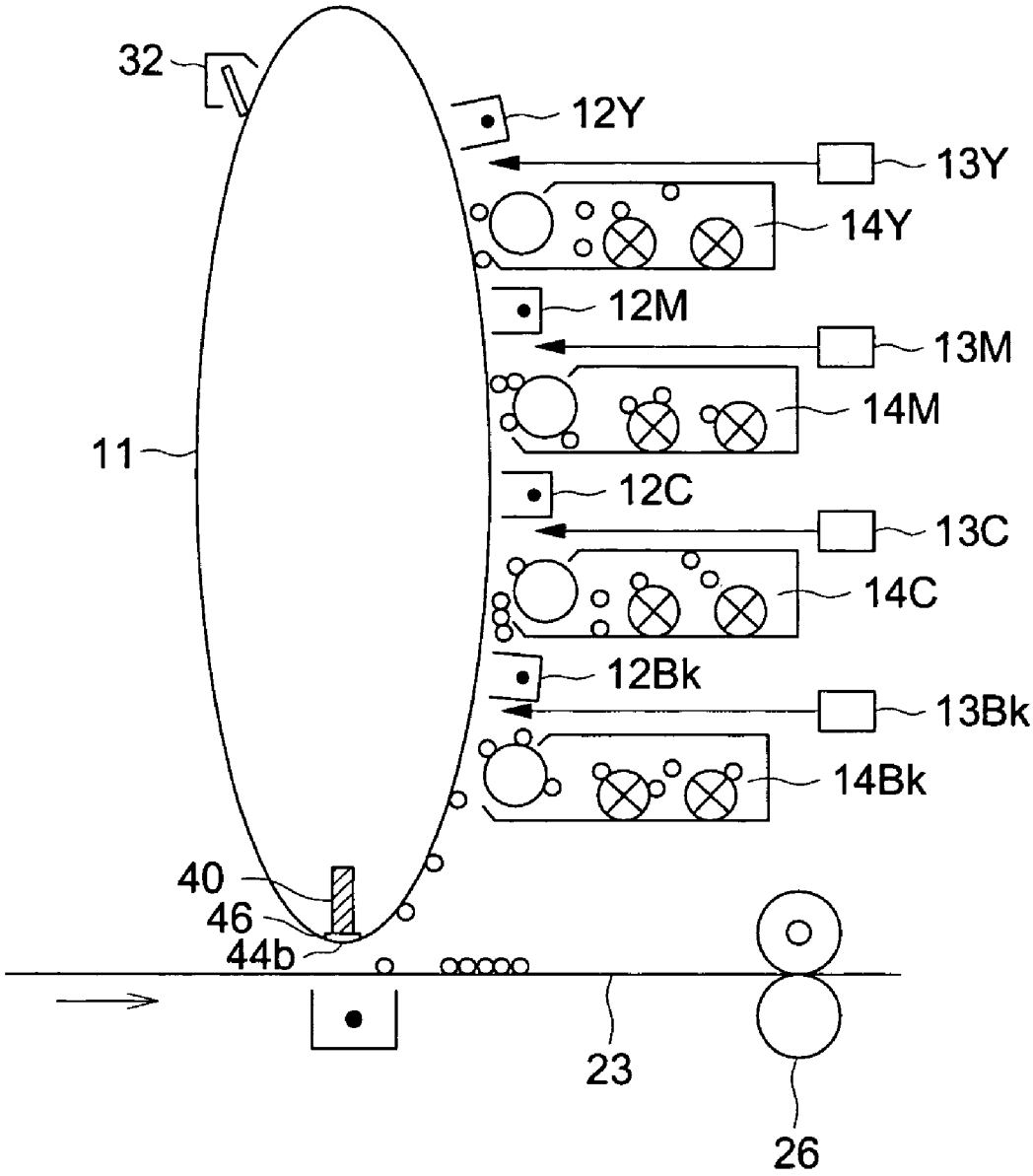
FIG. 4 is a schematic illustration showing another example of image forming apparatus to be employable in the invention.

In the image forming apparatus shown in FIGS. 2 to 4, the ultrasonic irradiation face 44*a* of the ultrasonic apparatus 40 is faced in parallel to the intermediate transfer belt 16 or the photoreceptor belt 11 and the image receiving material 23 so the toner image is between them at the transferring position. When the portion of the intermediate transfer belt 16 facing to the ultrasonic irradiation face 44*a* is defined as face 44*b*, the distance L2 between the ultrasonic wave irradiation face 44*a* and the face 44*b* facing to the face 44*a* is set so that the L2 is corresponded to an integer times of ½ of the wavelength $\lambda 2$ of the ultrasonic waves irradiated from the ultrasonic wave irradiation face 44*a*. The distance L2 between the ultrasonic wave irradiation face 44*a* and the face 44*b* is preferred since the highest sensitivity can be obtained when the L2 is ½ of the wavelength $\lambda 2$.

It is supposed that such the phenomenon is caused by formation of a standing wave between the ultrasonic irradiation face 44*a* of the ultrasonic wave apparatus 40 and the facing face 44*b* by agreement of the phase of the ultrasonic waves irradiated from the ultrasonic irradiation face 44*a* of the ultrasonic wave apparatus 40 and that of the ultrasonic waves reflected by the facing face 44*b*.

When the standing wave is formed, force larger than that the simple irradiation of ultrasonic waves affects to the face 44*a* positioned at the antinode portion of the vibration of the standing wave. For example, when an ultrasonic wave generation element 42 having a resonance frequency of 40 kHz, the wavelength $\lambda 2$ of the irradiated ultrasonic waves is approximately 17 mm even though which is influenced a little by the atmosphere temperature because the value of the $\lambda 2$ is the quotient of the sonic speed in air by the resonance frequency.

Image of light reflected by the original placed on the platen glass 3 and lighted by the light source 5 is read by CCD sensor 9 through the two scanning mirrors 6 and 7 and the focusing lens 8 as image signals of B (blue), G (green) and R (red). The read B,G and R signals are input into an image signal processing means 10 and converted to YMCK (yellow, magenta, cyan and black) signals and temporarily stored in a memory provided in the image signal processing means 10 according to necessity.

The photoreceptor drum 11 is uniformly charged at the designated potential by a charging device 12 and a static latent image is formed by a laser beam scanning means 13. The laser beam scanning means 10 scans the image carrying drum 11 by the laser beam according to the image data of each colors of yellow, magenta, cyan and black successively output from the image signal processing means 10, to perform imagewise exposure. Thus the static latent images are formed on the image carrying drum 11.

The static latent images formed on the photoreceptor drum 11 are each developed by the developing device 14Y, 14M, 14C and 14K to form yellow, magenta, cyan and black colored images, respectively. The toners of each color are negatively charged and adhered on the area exposed to the laser beam of the image carrying drum. One color of image is formed by one rotation of the image carrying drum 11, and four colored images are formed by four round of the drum.

The one color image formed by one rotation of the drum is transferred onto the intermediated transfer belt 16 on each time, and the four colored images are piled on the intermediate transfer belt 16 by repeating such the process for four times.

After transference of the four color images onto the intermediate transfer belt 16, the intermediate transfer belt is further circulated and the four color toner images are arrived at the position where the toner images are transferred to the image receiving material. The paper 23 contained in the paper supplying cassette 21 is conveyed by the conveying roller 22 synchronizing with the arrival of the piled toner images to the transferring position and further conveyed by the register roller 22 to the position of transfer from the intermediate transfer belt 16 to the image receiving material.

At the position of transfer from the intermediate transfer belt 16 to the image receiving material, the toner images on the intermediate transfer belt 16 are transferred onto the image receiving material by the ultrasonic wave generation element 42 and the horn 41.

FIG. 16 is a schematic illustration showing the transferring position of the intermediate transfer belt 16 and the image receiving material. At the transferring position where the intermediate transfer belt 16 and the image receiving material or paper 23 are faced to each other, the ultrasonic wave generation element 42 and the horn 41 are provided on back side of the paper 24. As is shown in FIG. 6, the end portion of the horn 41 is vibrated in the same phase (piston vibration) in the direction of the arrow and the standing wave is formed between the intermediate transfer belt 16 and the paper 24 around the horn.

To contribute with high efficiency the ultrasonic waves generated by the driving of the ultrasonic wave generation element 42 to the transfer, it is preferable that the paper 23 is strained by sufficient force so as to occur the ultrasonic vibration at the surface of the paper.

At the upper stream side and the lower stream side of the transferring position, pare of rollers 48 are arranged and a conveying belt 47 is provided between them to apply the strain force to the paper 23.

A power source, not shown in the drawing, may be attached to the rollers 48 and the conveying belt 47 for applying voltage in the direction so that the toner particles are not adhered.

As above-mentioned, the toner images piled on the intermediate transfer belt 16 is transferred onto the paper 23 at the transferring position by the ultrasonic waves.

A means utilizing static electricity force or heat for increasing the holding ability of the tone image may be provided to prevent the deformation if the image caused by the rebounding of the toner particle R or the use of paper having small mirror force generated by itself.

In concrete, a means in which a power source is connected to the horn 41 to apply voltage for holding the toner particle R, and a means in which a transferring roller capable of being applied voltage is touched to the back side of the paper 23 are employable. By such the means, charge is given to the paper 23 as to hold the toner particle R on the paper 23. A tension roller may be provided on the opposite side, through the horn 41, of the transfer holding roller may be arranged to prevent the slacking vibration of the paper 23.

The paper on which the toner image is transferred, is fixed by heating and pressure by the fixing device 26 and output on the tray 27, thus a series of color image forming cycle is completed.

On the other hand, the photoreceptor drum 11 after finishing of the image transfer to the intermediate transfer belt 16 is introduced to the next image forming cycle after removing of the toner remained on the surface by cleaning device 32. The intermediate transfer belt 16 after finishing of the image transfer to the paper 23 is introduced to next image forming cycle after removing of the toner remained on the surface of the intermediate transfer belt 16 by cleaning device 33.

As above-described, it is possible in the image forming apparatus employed in the invention to fly the toner particle for transferring by utilizing the sonic irradiation force of the ultrasonic standing wave on the occasion of transfer the toner image on the intermediate transfer belt to the image receiving material (paper 23), and the destroying of the toner particle caused by the releasing the particle of the releasing agent is avoided by the use of the toner in which the releasing agent is dispersed in the specified state so that the occurrence of deformation of image at the time of transfer can be prevented.

The invention can be also applied to the process in which the ultrasonic vibration is applied for transfer the toner image formed on the photoreceptor to the intermediate transfer belt 16 other than the process for transferring the toner image on the intermediate transfer belt 16 to the image receiving material. FIG. 3 is a schematic illustration showing an example of the image forming apparatus in which the toner image on the photoreceptor drum is transferred onto the intermediate transfer belt by the ultrasonic waves transfer method. It is also preferred in FIG. 3 that the gel member 46 is employed as the ultrasonic wave conductive means between the intermediate transfer belt and the ultrasonic apparatus 40 even though the gel member is not displayed in the drawing.

FIG. 4 is a schematic illustration of another full color image forming apparatus employable in the invention. In the image forming apparatus of FIG. 4, the full color toner image formed on the photoreceptor 11 is transferred onto the image receiving material.

In the image forming apparatus of FIG. 4, a unit image of yellow is firstly formed on the belt-shaped photoreceptor. The procedure is the same as that in the formation apparatus for the monocolor image; firstly the surface of the photoreceptor is uniformly charged by the charging device, the photoreceptor surface is imagewise exposed by the image exposure device and developed by the yellow color toner to form the yellow image.

A magenta, cyan and black images are formed on the same area of the photoreceptor by synchronized timing with the rotation of the photoreceptor 11.

When the photoreceptor 11 is arrived, by the continuation of the moving thereof, at the position of the ultrasonic apparatus corresponding to the facing face 44*b*, the full color toner image is transferred onto the image receiving material 23 conveyed by adjusted timing. The image receiving material 23 carrying the full color toner image is conveyed into the fixing device 26 and the color image is fixed on the image receiving material 23. It is also preferable in FIG. 4 that the gel member 46 is provided as the ultrasonic wave conducting member between the facing face 44*b* and the ultrasonic apparatus 40.

The photoreceptor 11 is further continuously rotated after transfer of the toner image, and the remained toner and paper powder on the surface of the photoreceptor are removed by the cleaning device 33 having a blade and then the photoreceptor is reused for next image formation.

The producing method of the toner to be employed in the invention is described bellow.

The toner contains a resin, colorant and releasing agent in the toner particle thereof. In concrete, the toner particle is preferably prepared by the followings processes: resin particles are formed by polymerization of a polymerizable monomer, and the colorant particles and the releasing agent particles are associated and aggregated with the resin particles in an aqueous medium to form the toner particles.

When the toner particle is formed by the aggregation, the resin particle preferably has some degree of adhesiveness.

The adhesiveness of the resin particle can be increased by making the structure of the resin particle to a plural layered structure (later-mentioned in detail) having a low molecular weight component as the surface layer, not uniform structure, so as to raise the inter-particle adhesiveness.

Moreover, the colorant can be contained between the resin particles at the step of association of the particles by dispersing the colorant in particles each having a diameter less than that of the resin particle.

In such the method, a large amount of a metal salt can be contained in the associated type toner for increasing the durability by adding excessive amount of a salting out agent on the occasion of the association of the resin particles and the colorant particles.

<Emulsion Polymerization Method>

A method for preparing the toner may be applied, in which the resin particles are salted out and fused in an aqueous medium. The aqueous medium is a medium containing not less than 50% by weight of water. Examples of such the method include those described in Japanese Patent O.P.I. Publication Nos. 5-265252, 6-329947 and 9-15904, even though there is no specific limitation on the method. Namely, the toner according to the invention can be formed by the method in which dispersed particles of the constituting materials such as the resin particles and the colorant or fine particles constituted by the resin and the colorant are salted out, aggregated and fused, particularly, these materials are dispersed in water by using a emulsifying agent and then slated out by addition of a aggregation agent in an amount of more than critical aggregation concentration and, at the same time, heated by a temperature higher than the glass transition point of the formed polymer to form and gradually grow fused particles; a large amount of water is added to stop the growing of the particle when the particle diameter is arrived at the designated value, the heating and the stirring are further continued to smooth the particle surface for controlling the shape of the particle; and thus obtained water containing particles in a fluidable state are heated and dried to obtain the toner of the invention.

The toner according to the invention may be one prepared by a method in which the composite resin particles prepared by polymerization of a polymerizable monomer dissolving therein the releasing agent and the colorant particles are salted out and fused. The dissolving of the releasing agent in the polymerizable monomer either may be performed by dissolution or by melting. The preferable preparation method of the toner according to the invention is a method in which the composite resin particles prepared by a poly-step polymerization method and the colorant particles are salted out and fused. The poly-step polymerization method is described below.

(Preparation Method of the Composite Resin Particles Obtained by then Poly-step Polymerization)

[Poly-step Polymerization Process]

In the poly-step polymerization process, the polymerization reaction is separated into plural steps to form phases each different from each other in the molecular weight distribution in one toner particle, the polymerization is intended such that the obtained particles form from the center to the surface of the particle layers each having the different in the molecular weight from each other. For example, a method is applied in which firstly high molecular resin particle dispersion is obtained and a polymerizable monomer and a chain-transfer agent are newly added to form the surface layer of low molecular resin.

As the poly-step polymerization, two-step and three-step polymerization are preferred. In the toner obtained by such the poly-step polymerization, it is preferable that the surface layer is comprised of a low molecular weight resin from the viewpoint of the anti-crushing strength.

As the polymerization method suitable for forming the resin particle or the covering layer each containing the releasing agent, a method is applicable in which a dispersion is prepared by dispersing in an oil droplet state a monomer solution composed of a monomer liquid and the releasing agent dissolved therein by utilizing mechanical energy in an aqueous medium containing a surfactant in a concentration of not more than the critical micelle concentration, and a water-soluble polymerization initiator is added to thus obtained so that radical polymerization is caused in the oil droplet. In the invention, such the method is referred to as mini-emulsion method. Such the method is preferable since the effect of the invention can be enhanced. An oil-soluble polymerization initiator may be employed instead of or together with the water-soluble polymerization initiator.

In the mini-emulsion method in which the oil droplet is mechanically formed, the releasing of the releasing agent dissolved in the oil phase is small and sufficient amount of the releasing agent can be introduced into the covering layer, different from usual emulsion polymerization method. It is also possible to control the nearest wall distance into the specified range according to the invention by intentionally controlling to occur suitable releasing of the releasing agent.

Though there is no limitation on the dispersing machine for dispersing the oil droplet by the mechanical energy, for example, a stirring apparatus Clearmix, manufactured by M•Tech Co., Ltd., having a rotor rotating at high speed, a ultrasonic dispersing machine, a mechanical homogenizer, Manton-Gaulin homogenizer and a pressure homogenizer are employable. The diameter of the dispersed particles is from 10 nm to 1 μm, preferably from 50 to 1,000 nm, and more preferably from 50 to 300 nm.

The size of the composite resin particle obtained by the polymerization process can be preferably within the range of from 10 nm to 1 μm in the weight average diameter measured by an electrophoretic light scattering photometer ELS-800, manufactured by Ootsuka Denshi Co., Ltd.

The glass transition point Tg of the resin particle is preferably within the range of from 44 to 74° C. and more preferably from 46 to 64° C.

The softening point of the resin particle is preferably within the range of from 95 to 140° C.

The toner according to the invention may be obtained by forming the resin layer formed by fusing the resin particles on the surface of the resin particle and the colored particle by the salting out/fusing method. Such the matter is described below.

[Colorant Particle]

The colorant particle is prepared by a dispersing apparatus for finely dispersing the colorant particle in an aqueous medium containing a surfactant.

In the aqueous medium, the surfactant is dissolved in a concentration not less than the critical micelle concentration (CMC); as the surfactant, the same as that employed in the foregoing polymerization process may be employed.

Though the dispersing machine to be employed for dispersing the colorant particle is not specifically limited, a dispersing machine such as the stirring apparatus Clearmix, manufactured by M•Tech Co., Ltd., having a rotor rotating at high speed, ultrasonic dispersing machine, mechanical homogenizer, Manton-Gaulin homogenizer and pressure homogenizer, and a medium dispersion type dispersing machine such as a Getzman mill and a diamond fine mill are employable.

[Salting Out/Fusion Process]

The process of salting out/fusion is a process to obtain the irregular (non-spherical) shaped particle by salting out/fusing (the salting out and the fusion of the particles are simultaneously progressed) the resin particles and the colorant particles dispersed as above.

The salt out/fusion means the phenomenon that the salt out (aggregation of the particles) and fusion (disappear of boundary of the particles) are simultaneously progressed, and an action to occur such the phenomenon. For simultaneously progressing the slat out and the fusion, the aggregation of the particles (the resin particles and the colorant particles) is performed at a temperature condition higher than the glass transition point Tg of the resin constituting the resin particle.

In the salt out/fusion process, an interior additive such as a charge controlling agent particle (fine particles having an average diameter of primary particles of from 10 nm to 1 μm) may be salted out/fused together with the resin particle and the colorant particles.

The salt out/fusion of the resin particles and the colored particles can be performed by adding the salting out agent (aggregation agent) in an amount of not less than the critical aggregation concentration to the dispersion in which the resin particles and the colorant particles are dispersed and simultaneously heating the dispersion by a temperature not less than the glass transition point Tg of the resin particle. The temperature range suitable for the salt out/fusion is from (Tg+10) to (Tg+50° C.), particularly preferably from (Tg+15) to (Tg+40° C.).

[Ripening Process]

The ripening process is a process to be continued to the salt out/fusion process, the nearest wall distance in the toner particle can be controlled by holding the temperature at a temperature of from (Tg+15) to (Tg+40° C.) and continuing the stirring at a constant strength after the fusion of the resin particles so as to fuse the resin particles and the colorant particles.

[Filtration•Washing Process]

The filtration•washing process is a filtration process to separate the toner particles from the toner particle dispersion obtained in the above process and a washing process to remove adhered substances such as the surfactant and the salting out agent from the separated toner particles as a cake like mass. As the filtration method, usual methods such as a centrifugal method, a vacuum filtration method using a Nutsche funnel, and-a filter press are applicable without any limitation.

[Drying Process]

This process is a process to dry the toner particles.

As the drying machine to be employed in this process, a spray drier, a vacuum freeze drying machine and a vacuum drier are employable, and a standing rack drying machine, a moving rack drying machine, a fluid bed drying machine, a rotary drying machine and a stirring drying machine are preferably employed.

The moisture content of the dried toner particles is preferably not more than 5% by weight and more preferably not more than 2% by weight.

The components to be employed in the toner production process are described in detail bellow.

(Polymerizable Monomer)

As the polymerizable monomer for forming the resin (binder), a hydrophobic monomer is the essential constituting component and a cross linkable monomer is employed according to necessity. It is preferable to contain at least one kind of monomer having an acidic polar group or monomer having a basic polar group in the structure thereof as shown below.

(1) Hydrophobic Monomer

As the hydrophobic monomer constituting the monomer component, usually known monomers can be employed without any limitation. The monomer may be employed solely or in combination of two or more kinds thereof for satisfying required properties.

In concrete, aromatic mono-vinyl type monomers, (meth-a)acrylate type monomers, vinyl ester type monomers, vinyl ether type monomers, mono-olefin type monomers, di-olefin type monomers and halogenated olefin type monomers are employable. Examples of the aromatic vinyl type monomer are styrene type monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

As the (meth)acrylate type monomers, acrylic acid, methacrylic acid, methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate are cited.

As the vinyl ester type monomers, vinyl acetate, vinyl propionate and vinyl benzoate, and as the vinylether type monomers, vinyl ethyl ether, vinyl isobutyl ether and vinyl phenyl ether are cited.

As the mono-olefin type monomers, ethylene, propylene, iso-butylene, 1-butene, 1-pnetene and 4-methyl-1-pentene, and as the di-olefin type monomers, butadiene, isoprene and chloroprene are cited.

(2) Crosslinkable Monomer

A crosslinkable monomer may be added to improve the properties of the resin particle. As examples of the crosslinkable monomers, ones having two or more unsaturated bonds such as divinylbenzene, divinylnaphthalene, divinyl ether, diethylene glycol methacrylate, ethylene glycol dimethacrylate and diallyl phthalate are cited.

(3) Monomer Having an Acidic Polar Group

As the monomers having an acidic polar group, (a) α,β-ethylenic unsaturated compounds each having a carboxyl group (—COOH), and (b) α,β-ethylenic unsaturated compounds each having a sulfonic group (—$SO_3$) can be cited.

Examples of α,β-ethylenic unsaturated compounds each having a carboxyl group of (a) are acrylic acid, methacrylic a acid, a fumalic acid, maleic acid, itaconic acid, cinnamic acid, mono-butyl maleate, mono-octyl maleate and their salts of a metal such as Na and Zn.

Examples of α,β-ethylenic unsaturated compounds each having a sulfonic group of (b) are sulfonated styrene and Na salt thereof, allylsulfosuccinic acid, octyl allylsulfosuccinate and their Na salts.

(Polymerization Initiator)

Radical polymerization initiators can be optionally employed as long as it is water soluble. For example, persulfates such as potassium persulfate and ammonium persulfate, azo compounds such as 4,4'-azo-bis-4-valeriate and its salt and 2,2'-azo-bis(2-aminopropane) salt, and peroxide compounds can be cited. The above-mentioned radical polymerization initiator can be employed as redox initiators in combination with a reducing agent according to necessity. The use of the redox type initiator shows some merits such as that the polymerization activity is increased so that the polymerization temperature can be lowered and the polymerization time can be shortened.

The polymerization temperature is not specifically limited as long as it is higher than the lowest radical generation temperature, for example, within the range of from 50° C. to 90° C. The polymerization can be also performed at a room temperature or more by the use of an initiator capable of initiating the polymerization at an ordinary temperature such as a combination of hydrogen peroxide and a reducing agent such as ascorbic acid.

(Chain-transfer Agent)

Known chain-transfer agents can be employed for controlling the molecular weight. Though the chain-transfer agent is not specifically limited, for example, octylmercaptane, dodecylmercaptane, tert-dodecylmercaptane, n-octyl-3-mercaptopropionate, ethyl thioglycolate, propyl thioglycolate, propyl thioglycolate, butyl thioglycolate, 2-ethylhexyl thioglycolate, octyl thioglycolate, decyl thioglycolate, dodecyl thioglycolate and compounds of ethylene glycol having a mercapto group are employable. Among them, n-octyl-3-mercaptopropionates and n-octylmercaptane are particularly preferable from the viewpoint of inhibiting the odor on the occasion of thermally fixing of the toner.

(Surfactant)

For performing the mini-emulsion polymerization, it is preferable that the monomer is dispersed in a state of oil droplet in the aqueous medium employing a surfactant. Though the surfactant to be used on such the occasion is not specifically limiter, the following surfactants can be exemplified as the suitable compounds.

As the ionic surfactant, for example, sulfonates such as sodium dodecylbenzenesulfonate, sodium aryl alkyl polyethersulfonate, sodium 3,3-disulfondiphenylurea-4,4-diazo-bis-amino-8-naphthol-6-sulfonate, orthocarboxybenzene-azo-dimethylaniline and sodium 2,2,5,5-tetramethyl-triphenylmethane-4,4-diazo-bis-β-naphthol-6-sulfonate; sulfate salts such as sodium dodecylsulfate, sodium tetradecylsulfate, sodium pentadecylsuofate and sodium octylsulfate; aliphatic acid salts such as sodium oleate, sodium laurate, sodium caprylate, sodium caprate, sodium caproate, potassium stearate and calcium oleate are cited.

The combination use of the following surfactant represented by Formula (1) and that represented by Formula (2) is preferred.

$$R_1(OR_2)_nOSO_3M \qquad \text{Formula (1)}$$

$$R_1(OR_2)_nSO_3M \qquad \text{Formula (2)}$$

In Formulas (1) and (2), $R_1$ is an alkyl group or an arylalkyl group having from 6 to 22 carbon atoms, preferably an alkyl or an arylalkyl group having from 8 to 20 carbon atoms, and more preferably an alkyl or an arylalkyl group having from 9 to 16 carbon atoms.

In Formulas (1) and (2), $R_2$ is an alkylene group having from 2 to 6 carbon atoms, and preferably an alkylene group having from 2 to 3 carbon atoms. Examples of the alkylene group having from 2 to 6 carbon atoms represented by $R_2$ are an ethylene group, a trimethylene group, a tetramethylene group, a propylene group and an ethylethylene group.

In Formulas (1) and (2), n is an integer of from 1 to 11, preferably from 2 to 10, more preferably from 2 to 5, and particularly preferably from 2 to 3.

In Formulas (1) and (2), the mono-valent metal element represented by M is sodium and lithium. Among them, sodium is preferably employed.

Concrete examples of the surfactant represented by Formula (1) or (2) are listed below; the invention is not limited to them.

Compound (101): $C_{10}H_{21}(OCH_2CH_2)_2OSO_3Na$, Compound (102): $C_{10}H_{21}(OCH_2CH_2)_3OSO_3Na$, Compound (103): $C_{10}H_{21}(OCH_2CH_2)_2SO_3Na$, Component (104): $C_{10}H_{21}(OCH_2CH_2)_3SO_3Na$, Compound (105): $C_8H_{17}(OCH_2CH(CH_3))_2SO_3Na$, and Compound (106): $C_{13}H_{37}(OCH_2CH_2)_2OSO_3Na$ (Molecular Weight Distribution of the Resin Particle and the Toner)

In the toner of the invention, it is preferable that the peak or the shoulder of the molecular weight distribution is within the ranges of from 100,000 to 1,000,000 and from 1,000 to 50,000, and more preferably within the ranges of from 100,000 to 1,000,000, from 25,000 to 150,000 and from 1,000 to 50,000.

As the resin of the resin particle, the use of one containing at least a high molecular weight component having the peak or shoulder of the molecular weight distribution within the range of from 100,000 to 1,000,000 and a low molecular weight component having the peak or shoulder within the range of from 1,000 to 50,000 is preferable and the use of intermediate molecular weight resin having the peak or shoulder within the range of from 15,000 to 100,000 is more preferable.

For measuring the molecular weight of the toner or the resin, the molecular weight measuring method by a gel permeation chromatography (GPC) employing tetrahydrofuran (THF) as the solvent is useful. Namely, 1.0 mg of THF is added to 0.5 to 5 mg, concretely 1 mg, of the sample and stirred by a magnetic stirrer to sufficiently dissolve the sample. After that, the solution is treated by a membrane filter with a pore size of from 0.45 to 0.50 μm and injected into GPC.

The Measuring conditions of the GPC are as follows: the column is stabilized at 40° C., and THF lets flow in a rate of 1.0 ml per minute, then 100 μl of the sample in a concentration of 1 mg/ml is injected for measurement.

A combination of polystyrene gel columns available on the market is preferably employed as the column. For example, a combination of Shodex GPC KF-801, 802, 803, 804, 805, 806 and 807, each manufactured by Showa Denko Co., Ltd., and a combination of TSK gel G1000H, G2000H, G3000, G4000, G5000, G6000, G7000 and TSK guard gel column, each manufactured by Toso Co., Ltd., are usable. As the detector, a refractive detector (IR detector) or UV detector is useful. In the molecular weight measurement of the sample, the molecular weight distribution of the sample is calculated by a calibration curve prepared by using monodispersed polystyrene standard particles. It is suitable to employ about ten kinds of the polystyrene particles for preparing the calibration curve.

(Aggregating Agent)

In the invention, metal salts are preferably employed as an aggregating agent in the process of salting out/fusing the resin particles from the dispersion of the resin particles prepared in the aqueous medium. Di-valent or tri-valent metal salts are more preferable because the critical aggregation concentration (aggregation value or aggregation point) of the di- or tri-valent metal salt is smaller than that of the mono-valent metal salt.

Concrete examples of the aggregating agent are as follows.

As the mono-valent metal salt, sodium chloride, potassium chloride and lithium chloride, as the di-valent metal salt, calcium chloride, zinc chloride, copper sulfate, magnesium sulfate and manganese sulfate, and as tri-valent metal salt, aluminum chloride and iron chloride are cited.

The critical aggregation concentration is an index of the stability of dispersion in an aqueous medium, which is the concentration of the aggregating agent at the starting of aggregation when the aggregating agent is added to the dispersion. The critical aggregation concentration is largely varied depending on the latex itself and the kind of the aggregating agent. For example, S. Okamura et al. "Koubunshi Kagaku (Polymer Chemistry)", 17, 601, 1960 describes in detail about the critical aggregation concentration, the value of that can be known by this publication. In another method, the designated salt is added in various concentrations to the subjective particle dispersion and ζ-potential of the dispersion is measured. The critical aggregation concentration can be determined by the concentration of the salt at which beginning variation of the ζ-potential is observed.

In the invention, it is suitable to treat the polymer fine particle dispersion by applying a concentration the metal salt not less than the critical aggregation concentration; the metal salt is preferably added for not less than 1.5 times and more preferably not less than 2.0 times of the critical aggregation concentration.

(Colorant)

The toner according to the invention can be obtained by salting out/fusing the above-mentioned composite resin particles and the colorant particles. Various inorganic pigments, organic pigments and dyes can be cited as the colorant. Usually known inorganic pigments are employable. Concrete examples of the inorganic pigment are described below.

For example, carbon black such as furnace black, channel black, acetylene black, thermal black and lamp black, and magnetic powder such as magnetite and ferrite are employable as the black pigment.

These inorganic pigments can be employed solely or in a combination of plural kinds thereof. The adding amount of the pigment is from 2 to 20%, and preferably from 3 to 15%, by weight of the polymer.

Usually known organic pigments and dyes can be employed; concrete organic pigments and dyes are listed below.

The pigments for magenta or red color are, for example, C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178 and C. I. Pigment Red 222.

The pigments for orange or yellow color are, for example, C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 180, C. I. Pigment Yellow 185, C. I. Pigment Yellow 155 and C. I. Pigment Yellow 156.

Pigments for green or blue color are, for example, C. I. Pigment Blue 15, C. I. Pigment Blue 15:2, C. I. Pigment Blue 15:3, C. I. Pigment Blue 16, C. I. Pigment Blue 60 and C. I. Pigment Green 7.

Dyes, for example, C. I. Solvent Reds 1, 49, 52, 63, 111 and 122, C. I. Solvent Yellows 19, 44, 77, 79, 81, 82, 93, 98, 103, 104, 112 and 162, and Solvent Blues 25, 36, 60, 70, 93 and 95 are employable. A mixture of them can be also employable.

These organic pigments can be employed solely or in a combination of plural kinds thereof. The adding amount of the pigment is from 2 to 20%, and preferably from 3 to 15%, by weight of the polymer.

(Releasing Agent)

The toner to be employed in the invention can be obtained by fusing the resin particles containing the releasing agent in the aqueous medium and then aggregating the resin particles containing the releasing agent in the ripening process. The toner in which the releasing agent is finely dispersed, can be obtained by salting out/fusing the resin particles containing the releasing agent and the colorant particles in the aqueous medium.

The ripening process is a process in which the stirring is continued after the fusion of the resin particles at a temperature within the range of from the melting point of the releasing agent to the melting point plus 20° C. In the invention, the nearest wall distance can be suitably controlled when the temperature is within the range of from the melting point of the releasing agent to the melting point plus 20° C.

As the releasing agent, low molecular polypropylene (number average molecular weight=1,500–9,000) and low molecular weight polyethylene is preferable and the ester compounds represented by the following Formula are particularly preferred.

$$R_1—(OCO—R_2)_n$$

In the formula, n is an integer of from 1 to 4, preferably from 2 to 4, more preferably from 3 to 4, and most preferably 4. $R_1$ and $R_2$ are each a hydrocarbon group which may have a substituent. The number of the carbon atom in $R_1$ is from 1 to 40, preferably from 1 to 20, and more preferably from 2 to 5. $R_2$ has from 1 to 40, preferably 16 to 30, and more preferably from 18 to 26 carbon atoms.

Typical examples of the compound are listed below.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

8) $CH_3—(CH_2)_{22}—COO—CH_2—CH(CH_3)—CH_2—O—CO—(CH_2)_{22}—CH_3$

9) $CH_3—(CH_2)_{26}—COO—CH_2—CH(CH_3)—CH_2—O—CO—(CH_2)_{26}—CH_3$

10) $CH_2—O—CO—(CH_2)_{26}—CH_3$
$CH—O—CO—(CH_2)_{26}—CH_3$
$CH_2—O—CO—(CH_2)_{26}—CH_3$

11) $CH_2—O—CO—(CH_2)_{22}—CH_3$
$CH—O—CO—(CH_2)_{22}—CH_3$
$CH_2—O—CO—(CH_2)_{22}—CH_3$

12) $CH_2—OH$
$CH—O—CO—(CH_2)_{26}—CH_3$
$CH_2—O—CO—(CH_2)_{26}—CH_3$

-continued

13)

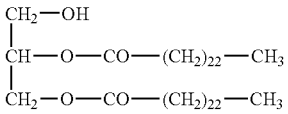

14)

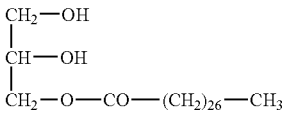

15)

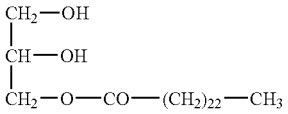

16)

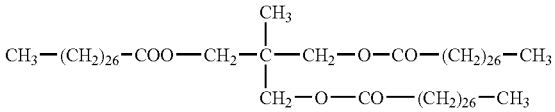

17)

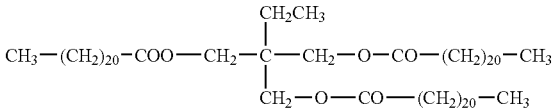

18)

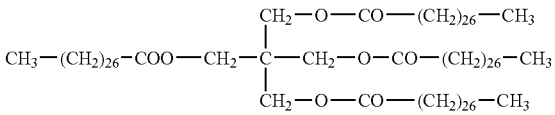

19)

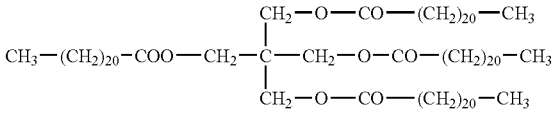

20)

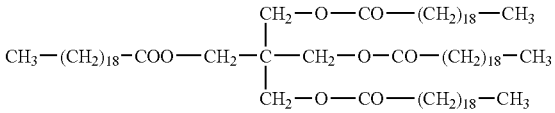

21)

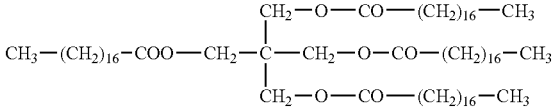

Though the method to add the releasing agent to the toner is not specifically limited, for example, the following methods are applicable; a method in which the releasing agent is salted out/fused with the resin particles in the same manner as for the colorant particles, and a method in which the fixing ability improving agent is added into the monomer for preparing the resin particle and then the monomer is polymerized to prepare the resin particles.

In the toner to be used in the invention, various kinds of charge controlling agent can be employed. The charge controlling agent is not specifically limited as long as the agent can be dispersed in water. Concrete examples of the charge controlling agent include nigrosine type dyes, metal salts of naphthenic acid or high fatty acid, alkoxylated amines, quaternary ammonium compounds, azo type metal complexes, metal salts of salicylic acid and its metal complexes.

The charge controlling agent is preferably made in a dispersed state having a number average primary particle diameter of from 10 to 500 nm.

In the toner to be used in the invention, an external additive may be added to the toner particles and adhered onto the toner surface by high speed stirring. By adhesion of the external additive on the toner particle surface, a better image can be obtained.

As the external additive, an inorganic particle or an organic particle may be employed, but the external additive is not limited to them.

Inorganic particles such as silica, titania and alumina are preferred as the inorganic particle.

In concrete, the silica fine particle such as R-805, R-976, R-974, R-972, R-812 and R-809 each manufactured and marketed by Nihon Aerogel Co., Ltd., HVK-2150 and H-200 manufactured by Hoechst Co., Ltd., TS-720, TS-530, TS-610, H-5 and MS-5 each manufactured and marketed by Cabot Co., Ltd., are cited.

As the titan fine particle, for example, T-805 and T-604 each manufactured and marketed by Nihon Aerogel Co., Ltd., MT-100S, AT-100B, MT-500BS, MT-600, MT-600SS and JA-1 each manufactured and marketed by Teica Co., Ltd., TA-300SI, TA-500, TAF-130, TAF-510 and TAF-510T each manufactured and marketed by Fuji Titan Co., Ltd., and IT-S, IT-OA, IT-OB and IT-OC manufactured and marketed by Idemitsu Kosan Co., Ltd., are cited.

As the alumina fine particle, for example, RFY-C and C-604 each manufactured and marketed by Nihon Aerogel Co., Ltd., and TTO manufactured and marketed by Ishihara Sangyo Co., Ltd., are cited.

These inorganic fine particles are preferably subjected to a hydrophobilizing treatment by a silane coupling agent or a silane coupling agent. Though the degree of the hydrophobilizing treatment is not specifically limited, a methanol wettability of from 40 to 95 is preferable.

The methanol wettability indicates the easiness of wetting to methanol. The method of measurement of the methanol wettability is as follows: 0.2 g of the organic fine particles to be measured is added into 50 ml of distillated water put in a 200 ml beaker. Methanol is gradually added from a bullet, the lower end of which is immersed in the liquid, to the liquid until the inorganic particles are entirely wetted while slowly stirred. When the amount of methanol necessary for completely wetting the organic fine particles is "a" in ml, the hydrophilicity is calculated according to the following equation.

$$\text{Hydrophilicity (\%)}=[a/(a+50)]\times 100$$

Spherical organic fine particles having a number average primary particle diameter of from 10 to 2,000 nm can be employed as the organic fine particles. In concrete, styrene resin fine particles, styrene-acryl resin fine particles, polyester resin fine particles and urethane resin fine particles are preferably employable.

The adding amount of the external additive is preferably from 0.1 to 5.0%, and more preferably from 0.5 to 4.0%, by weight of the toner. Plural kinds of the exterior additive may be employed in combination.

Usually known various kinds of mixer such as a tabular mixer, a Henschel mixer, a nauter mixer and a V type mixer are applicable as the adding method of the external additive.

(Developer)

The toner according to the invention may be either employed as a single-component developer or double-component developer. When the toner is employed as the single-component developer, the toner is applicable for both of a non-magnetic single-component developer and a magnetic single-component developer in which magnetic particles of from 0.1 to 0.5 μm are contained in the toner particle.

The toner may be employed as the double-component developer by mixing with a carrier. In such the case, usually known materials such as metal such as iron, ferrite and magnetite, an alloy of the metal with aluminum or lead can be employed as the magnetic particle of the carrier. The magnetic particle is preferably one having a volume average particle diameter of from 15 to 100 μm, and more preferably from 25 to 80 μm.

The measurement of the volume average particle diameter can be performed by a laser diffraction particle size distribution measuring apparatus HELOS, manufactured by Sympatec Co., Ltd., having a wet type dispersion means.

As the carrier, a magnetic particle coated with resin and a resin dispersed type carrier composed of magnetic particles dispersed in the resin are preferred. Though the resin composition for coating is not specifically limited, for example, olefin type resins, styrene type resins, Styrene-acryl type resins, silicone type resins, ester type resins or fluorine-containing polymer type resins are employable. As the resin for constituting the resin dispersed type carrier, known ones can be employed without any limitation, for example, styrene-acryl type resins, polyester resins, fluorinated type resins and phenol resins are usable.

EXAMPLES

The present invention is described in detail below referring examples; the embodiment of the invention is not limited to the examples.

Preparation Example of Resin Particles for Toner [Latex 1HML]

(1) Preparation of Nucleus Particle (First Step of Polymerization):

Into a 5,000 ml separable flask to which a stirring device, a thermal sensor, a cooler and a nitrogen gas introducing device were attached, a surfactant solution (aqueous medium) composed of 3010 g of deionized water and 7.08 g of anionic surfactant (101) $C_{10}H_{21}(OCH_2CH_2)_2OSO_3Na$ dissolved therein was charged and the temperature in the flask was raised by 80° C. while stirring at a stirring speed of 230 rpm in a stream of nitrogen.

To the surfactant solution, an initiator solution composed of 9.2 g of polymerization initiator (potassium persulfate: KPS) dissolved in 200 g of deionized water and the temperature was adjusted to 75° C. After that, a monomer mixture composed of 70.1 g of styrene, 19.9 g of n-butyl acrylate and 10.9 g of methacrylic acid is dropped to the liquid spending for one hour, and the system was heated and stirred for 2 hours at 75° C. to perform polymerization (the first step polymerization). Thus latex (a dispersion of particles of a high molecular weight resin) was preferred. The latex was referred to as Latex 1H.

(2) Formation of Intermediate Layer (The Second Step Polymerization)

In a flask having a stirring device, 98.0 g of the compound represented by the foregoing Formula 19, hereinafter referred to as Exemplified Compound 19, was added to a monomer mixture liquid composed of 105.6 g of styrene, 30.0 g of n-butyl acrylate, 6.2 g of methacrylic acid and 5.6 g of n-octyl 3-mercaptopropionate and dissolved by heating by 90° C. to prepare a monomer solution.

Besides, a surfactant solution composed of 2,700 ml of deionized water and 1.6 g of the anionic surfactant (represented by Formula 101) dissolved therein was heated by 98° C., and 28 g in terms of solid component of the foregoing Latex 1H, which is dispersion of the nucleus particles, was added to the surfactant solution. Thereafter, the foregoing monomer solution containing Exemplified Compound 19 was mixed with the above mixture and dispersed for 8 hours by a mechanical dispersing apparatus having a circulation pass Cleamix, manufactured by M•Technic Co., Ltd., to prepare a dispersion (emulsion) containing emulsified particles (oil droplets).

And then 750 ml of deionized water and an initiator solution composed of 5.1 g of the initiator (KPS) and 240 ml deionized water were added, and this system was heated and stirred for 12 hours at 98° C. to perform polymerization (the second step polymerization). Thus latex (a dispersion of composite resin particles each composed of the resin particle of high molecular weight resin covered with medium molecular weight resin on the surface thereof was obtained. This latex was referred to as Latex 1HM.

Particles principally composed of Exemplified Compound 19 (400 to 1,000 nm) not surrounded by the latex were observed when Latex 1HM is dried and observed by a scanning electron microscope.

(3) Formation of Outer Layer (the Third Step Polymerization)

To Latex 1HM obtained as above, an initiator solution composed of 7.4 g of the initiator (KPS) dissolved in 200 ml of deionized water was added, and a monomer mixture liquid composed of 300 g of styrene, 95 g of n-butyl acrylate, 15.3 g of methacrylic acid and 10.4 g of n-octyl 3-mercaptopropionate was dropped spending 1 hour at a temperature of 80° C. After completion of the dropping, polymerization (the third step polymerization) was performed by heating and stirring for 2 hours and then cooled by 28° C. to obtain latex (a dispersion of composite resin particles each composed of a central portion of the high molecular weight resin, an intermediate layer of the medium molecular weight resin and containing Exemplified Compound 19 and an outer layer of the low molecular weight resin). The latex was referred to as Latex 1HML.

The composite resin particle constituting Latex 1HML had peaks of the molecular weight distribution at 138,000, 80,000 and 13,000, and the weight average particle diameter of the composite resin particles was 122 nm.

[Latex 2HML]

Latex (a dispersion of composite resin particles each composed of a central portion of the high molecular weight resin, an intermediate layer of the medium molecular weight resin and an outer layer of the low molecular weight resin) was prepared in the same manner as in Latex 1HML except that 7.08 g of an anionic surfactant (sodium dodecylbenzenesulfonate, SDS) was employed in the place of Surfactant 101. The latex was referred to as Latex 2HML.

The composite resin particle constituting Latex 2HML had peaks of the molecular weight distribution at 138,000, 80,000 and 12,000, and the weight average particle diameter of the composite resin particles was 110 nm.

Preparation Examples of Colored Particle

[Preparation of Colored Particles 1Bk through 8Bk and Comparative Colored Particles 1Bk through 3Bk]

To 1,600 ml of deionized water, 59.0 g of anionic surfactant 101 was dissolved by stirring, 420.0 g of carbon black Leagul 330, manufactured by Cabot CO., ltd., was gradually added to the above solution while stirring, and then dispersed by Cleamix, manufactured by M•Technic CI., Ltd., to prepare a dispersion of colorant particles. The colorant dispersion was referred to as Colorant Dispersion Bk. The weight average of the colorant particles in the colorant dispersion was 89 nm by measurement using an electrophoretic light scattering photometer ESL-800 manufactured by Ootsuka Denshi Co., Ltd.

The resin particles and the colorant particles were aggregated employing Latex 1HML and Latex 2HML.

In a reaction vessel (a four-mouth flask) to which a thermal sensor, a cooler, a nitrogen introducing device and a stirrer were attached, 420.7 g in terms of solid component of Latex 1HML, 900 g f deionized water and 166 g of Colorant Dispersion 1Bk were charged and stirred. After adjusting the temperature in the vessel to 30° C., the pH of the liquid was adjusted to 8 to 10.0 by adding a 50 mol/L aqueous solution of sodium hydroxide.

After that, a solution of 12.1 g of magnesium chloride hexahydrate in 1,000 ml of deionized water was added to the above liquid spending 10 minutes at 30° C. After standing for 3 minutes, the temperature of this system was raised by 90° C. spending 6 to 60 minutes to form associated particles (aggregation process). In such the situation, the diameter of the associated particles were measured by Coulter Counter TA-II, and an aqueous solution of 40.2 g of sodium chloride in 1,000 ml of deionized water was added to the system to stop the growing of the particles at the time when the number average diameter was attained by 3 to 7 μm. The system was further heated and stirred for 6 hours at 98° C. as the ripening treatment for continuing fusion of the particles and phase separation of the releasing agent (ripening process).

Moreover, 96 g of Latex 2HML (dispersion of resin particles) was added and heated and stirred for 3 hours to fuse Latex 2HML onto the aggregated particle of Latex 1HML. After that, 40.2 g of sodium chloride was added and cooled by 30° C. in a rate of 8° C. per minute. And then pH was adjusted to 2.0 by addition of hydrochloric acid, and stirring was stopped. Thus formed associated particles were filtered and repeatedly washed by deionized water of 45° C., and dried by air of 40° C. Thus Colored Particles 1Bk through 8Bk and Comparative Colored Particles 1Bk through 3Bk were obtained.

[Preparation of Colored Particle 9Bk and Comparative Colored Particle 4Bk]

Colored Particle 9Bk and Comparative Colored Particle 4Bk were obtained in the same manner as in the preparation of Colored Particles 1Bk through 8Bk and Comparative Colored Particles 1Bk through 3Bk except that Latex 2HML was not added.

[Preparation of Colored Particles 1Y through 8Y and Comparative Colored Particles 1Y through 3Y]

Ninety grams of anionic surfactant 101 was dissolved by stirring in 1,600 ml of deionized water. To the solution, 420 g of pigment, C. I. Solvent Yellow 93, was gradually added while stirring and dispersed by a stirring apparatus Cleamix, manufactured by M•Technic Co., Ltd., to prepare a dispersion of the colorant particles. The dispersion was referred to as Colored Dispersion Y. The average particle diameter in Colored Dispersion Y measured by an electrophoretic light scattering photometer ELS-800, manufactured by Ootsuka Denshi Co., Ltd., was 250 nm in weight average particle diameter.

Colored Particles 1Y through 8Y and Comparative Colored Particles 1Y through 3Y were each prepared in the same manner as in Colored Particles 1Bk through 8Bk and Comparative Colored Particles 1Bk through 3Bk, respectively, except that 158 g of Colorant Dispersion Y was employed in place of 166 g of Colorant Dispersion Bk.

[Preparation of Colored Particle 9Y and Comparative Colored Particle 4Y]

Colored Particle 9Y and Comparative Colored Particle 4Y were prepared in the same manner as in the above-described Colored Particles 1Y through 8Y and Comparative Colored Particles 1Y through 3Y except that Latex 2HML was not added.

[Preparation of Colored Particles 1M through 8M and Comparative Colored Particles 1M through 3M]

Ninety grams of anionic surfactant 101 was dissolved by stirring in 1,600 ml of deionized water. To the solution, 420 g of pigment, C. I. Pigment Red 122, was gradually added while stirring and dispersed by a stirring apparatus Cleamix, manufactured by M•Technic Co., Ltd., to prepare a dispersion of the colorant particles. The dispersion was referred to as Colored Dispersion M. The average particle diameter in Colored Dispersion M measured by an electrophoretic light scattering photometer ELS-800, manufactured by Ootsuka Denshi Co., Ltd., was 250 nm in weight average particle diameter.

Colored Particles 1M through 8M and Comparative Colored Particles 1M through 3M were each prepared in the same manner as in Colored Particles 1Bk through 8Bk and Comparative Colored Particles 1Bk through 3Bk, respectively, except that 166 g of Colorant Dispersion M was employed in place of 166 g of Colorant Dispersion Bk.

[Preparation of Colored Particle 9M and Comparative Colored Particle 4M]

Colored Particle 9M and Comparative Colored Particle 4M were prepared in the same manner as in the above-described Colored Particles 1M through 8M and Comparative Colored Particles 1M through 3M except that Latex 2HML was not added.

[Preparation of Colored Particles 1C through 8C and Comparative Colored Particles 1C through 3C]

Ninety grams of anionic surfactant 101 was dissolved by stirring in 1,600 ml of deionized water. To the solution, 400 g of pigment, C. I. Pigment Blue 15:3, was gradually added while stirring and dispersed by a stirring apparatus Cleamix, manufactured by M•Technic Co., Ltd., to prepare a dispersion of the colorant particles. The dispersion was referred to as Colored Dispersion C. The average particle diameter in Colored Dispersion C measured by an electrophoretic light scattering photometer ELS-800, manufactured by Ootsuka Denshi Co., Ltd., was 250 nm in weight average particle diameter.

Colored Particles 1C through 8C and Comparative Colored Particles 1C through 3C were each prepared in the same manner as in Colored Particles 1Bk through 8Bk and Comparative Colored Particles 1Bk through 3Bk, respectively, except that 98.7 g of Colorant Dispersion C was employed in place of 166 g of Colorant Dispersion Bk.

[Preparation of Colored Particle 9C and Comparative Colored Particle 4C]

Colored Particle 9C and Comparative Colored Particle 4C were prepared in the same manner as in the above-described Colored Particle 1C through 8C and Comparative Colored Particles 1C through 3C except that Latex 2HML was not added.

The number average diameter, the nearest distance between the islands of the releasing agent in the colored particle are listed in Tables 1 and 2.

TABLE 1

| Colored Particle | Number average particle diameter (μm) | Average of the nearest wall distance (in nm) | Ratio of island having the nearest wall distance of 1300 nm (% in number) |
|---|---|---|---|
| 1Bk | 5.7 | 102 | 6.9 |
| 2Bk | 3.7 | 225 | 5.3 |
| 3Bk | 2.7 | 261 | 3.5 |
| 4Bk | 3.5 | 402 | 1.5 |
| 5Bk | 5.5 | 544 | 0.1 |
| 6Bk | 4.8 | 678 | 2.4 |
| 7Bk | 6.8 | 818 | 5.1 |
| 8Bk | 2.2 | 1058 | 9.7 |
| 9Bk | 4.6 | 755 | 5.8 |
| Comparative 1Bk 1Bk | 7.8 | 97 | 6.9 |
| Comparative 1Bk 2Bk | 8.5 | 1070 | 11.5 |
| Comparative 1Bk 3Bk | 8.6 | 1250 | 30.7 |
| Comparative 1Bk 4Bk | 1.8 | 1134 | 18.6 |
| 1Y | 5.9 | 105 | 7.0 |
| 2Y | 3.5 | 230 | 5.2 |
| 3Y | 2.9 | 258 | 3.7 |
| 4Y | 3.7 | 410 | 1.6 |
| 5Y | 5.4 | 547 | 0.2 |
| 6Y | 5.0 | 682 | 2.7 |
| 7Y | 6.7 | 815 | 4.9 |
| 8Y | 2.5 | 1051 | 9.8 |
| 9Y | 4.7 | 760 | 5.6 |
| Comparative 1Bk 1Y | 7.3 | 95 | 7.1 |
| Comparative 1Bk 2Y | 8.3 | 1077 | 11.8 |
| Comparative 1Bk 3Y | 8.7 | 1252 | 29.9 |
| Comparative 1Bk 4Y | 1.7 | 1137 | 18.9 |

TABLE 2

| Colored Particle | Number average particle diameter (μm) | Average of the nearest wall distance (in nm) | Ratio of island having the nearest wall distance of 1300 nm (% in number) |
|---|---|---|---|
| 1M | 5.8 | 106 | 6.7 |
| 2M | 3.9 | 221 | 5.1 |
| 3M | 2.8 | 267 | 3.6 |
| 4M | 3.4 | 405 | 1.7 |
| 5M | 5.7 | 541 | 0.1 |
| 6M | 4.7 | 675 | 2.6 |
| 7M | 6.9 | 821 | 5.3 |
| 8M | 2.0 | 1059 | 9.5 |
| 9M | 4.5 | 761 | 6.0 |
| Comparative 1M | 7.3 | 94 | 6.8 |
| Comparative 2M | 8.7 | 1080 | 12.0 |
| Comparative 3M | 8.5 | 1260 | 31.3 |
| Comparative 4M | 1.6 | 1131 | 17.8 |
| 1C | 5.5 | 101 | 7.0 |
| 2C | 3.8 | 219 | 5.5 |
| 3C | 2.9 | 266 | 3.8 |
| 4C | 3.3 | 408 | 1.4 |
| 5C | 5.8 | 550 | 0.3 |
| 6C | 4.5 | 673 | 2.7 |
| 7C | 6.7 | 815 | 4.9 |
| 8C | 2.1 | 1057 | 10.0 |

TABLE 2-continued

| Colored Particle | Number average particle diameter (μm) | Average of the nearest wall distance (in nm) | Ratio of island having the nearest wall distance of 1300 nm (% in number) |
|---|---|---|---|
| 9C | 4.8 | 753 | 6.0 |
| Comparative 1C | 7.2 | 96 | 7.1 |
| Comparative 2C | 8.6 | 1077 | 13.5 |
| Comparative 3C | 8.8 | 1258 | 31.5 |
| Comparative 4C | 1.5 | 1140 | 19.6 |

[Addition of External Additive]

To each of thus obtained Colored Particles Bk1 through C9 and Comparative Colored Particles 1Bk through 4C, 0.8 parts by weight of hydrophobic silica, 1.0 part by weight of hydrophobic titanium oxide were added and mixed for 25 minutes by a 10L of Henschel mixer at a circumference speed of the rotating wings of 30 m/s. The shape and the diameter of each of the colored particles were not varied by the addition of the external additives.

Preparation of Carrier

[Preparation of Ferrite Core Material]

In a wet type ball mill, 18 mole-% of MnO, 4 mole-% of MgO and 78 mole-% of $Fe_2O_3$ were crushed and mixed for 2 hours and dried. After that, the dried mixture was provisionally baked at 900° C. for 2 hours, and crushed by a ball mill for 3 hours and made to slurry. The slurry was granulated and dried by a spray dryer after the addition of a dispersing agent and a binder, and then the dried granules were subjected to main baking at 1,200° C. for 3 hours. Thus ferrite core material granules having an electro-resistivity of $4.3\times10^8$ Ω·cm were obtained.

[Preparation of Coating Resin]

Copolymer of cyclohexyl methacrylate/methyl methacrylate (polymerization ratio of 5/5) was synthesized by emulsion polymerization method in an aqueous solution of 0.3% by weight of sodium benzenesulfonate having an alkyl group containing 12 carbon atoms as a surfactant. The copolymer has a volume average diameter of the primary particles of 0.1 μm, a weight average molecular weight (Mw) of 200,000, a number average molecular weight (Mn) of 91,000, an Mw/Mn ratio of 2.2, a softening point (Tsp) of 230° C. and a glass transition point (Tg) of 110° C.

Into a high speed stirring mixer having stirring wings, 100 parts by weight of the ferrite core granule and 2 parts by weight of the above-described resin fine particle were put and stirred for 30 minutes at 120° C. so as to be obtain resin coated carrier having a volume average particle diameter of 61 μm by utilizing the effects of the mechanical impact.

Preparation of Developer

Each of Colored Particles Bk1 through C9 and Comparative Colored Particles 1Bk through 4C, in which the external additives were added, was mixed with the above carrier to prepare developers of each color having a toner concentration of 6% by weight. The developers of each color were combined as shown in Table 3 so as to make Developer Sets 1 trough 9 and Comparative Developer Sets 1 through 4.

TABLE 3

| Developer Set No. | Developer No. Black (Bk) | Yellow (Y) | Magenta (M) | Cyan (C) |
|---|---|---|---|---|
| Developer Set 1 | 1Bk | 1Y | 1M | 1C |
| Developer Set 2 | 2Bk | 2Y | 2M | 2C |
| Developer Set 3 | 3Bk | 3Y | 3M | 3C |
| Developer Set 4 | 4Bk | 4Y | 4M | 4C |
| Developer Set 5 | 5Bk | 5Y | 5M | 5C |
| Developer Set 6 | 6Bk | 6Y | 6M | 6C |
| Developer Set 7 | 7Bk | 7Y | 7M | 7C |
| Developer Set 8 | 8Bk | 8Y | 8M | 8C |
| Developer Set 9 | 9Bk | 9Y | 9M | 9C |
| Comparative Developer Set 1 | Comparative 1Bk | Comparative 1Y | Comparative 1M | Comparative 1C |
| Comparative Developer Set 2 | Comparative 2Bk | Comparative 2Y | Comparative 2M | Comparative 2C |
| Comparative Developer Set 3 | Comparative 3Bk | Comparative 3Y | Comparative 3M | Comparative 3C |
| Comparative Developer Set 4 | Comparative 4Bk | Comparative 4Y | Comparative 4M | Comparative 4C |

Experiment 1

Image forming experiments were carried out employing the above-described developers and the full color image forming apparatus shown in FIG. 2.

The ultrasonic waves to be applied to the photoreceptor and the image receiving material was generated by the following conditions.

Conditions of the Ultrasonic Wave Generating Apparatus

Distance L2 between the ultrasonic waves irradiating face to the face facing to the irradiating face: 4.25 mm Resonance frequency of the ultrasonic wave generation element: 40 kHz Output electric power of the ultrasonic wave generation element: 5 W The fixing was carried out by the method employing the heating roller set at 165° C. and at a line speed of 420 mm/sec.

Under the above conditions, 100,000 sheets of image formation were carried out. The same evaluations were performed about image formation under a low temperature and low humidity condition at 10° C. and 20% RH, referred to as LL, and a high temperature and high humidity condition at 30° C. and 85% RH, referred to as HH; the fluctuation of the image formation is considerably expanded under such the conditions.

Concrete evaluation items were as follows.

Evaluation of Transfer Ability

<Transfer Efficiency>

The color difference between the first printed image and the 100,000$^{th}$ print image was evaluated as the indicator of the variation of the transfer efficiency.

Concretely, the colors of the solid image of secondary colors (red, green and blue) formed on the first and 100,000$^{th}$ images each printed under the both of the conditions were measured by Macbeth Color-eye 7000 and the color difference was calculated by CMC (2:1) color difference equation.

When the color deference calculated by the CMC (2:1) color difference formula is not more than 5, it was judged that the variation of the color of the formed images was within the acceptable range and the good transfer efficient was maintained.

<Deformation of Image>

For evaluation of the image deformation, the image deformation on the occasion of the transfer and that on the occasion of the fixing were evaluated about the resolution or file line reproducibility of the line image formed by dots of four colors. The line image was formed in the direction crossing to the direction of the development of the image forming apparatus, the resolution represented by line/mm was evaluated according to the distinguish ability of the fine lines by the observation through a loupe having a magnitude of 10 times.

In the evaluation of the resolution, situation of the occurrence of scattering around the image was evaluated together with. The observation results of the scattering were classified into the following four ranks.

A: No scattering was observed around the image even when the image was observed through the loupe.

B: The scattering around the image was observed by the loupe but the scattering was not observed by human eyes.

C: The scattering around the line was observed.

D: The scattering was considerably occurred so that the lines were indistinguishable.

Fixing Ability

<Anti-offset Ability>

After printing of 100,000 sheets, white paper was printed and the situation of the contamination caused by the offset and that of the surface of the heating roller by the toner were visually evaluated. For the evaluation, thick high quality paper with a weight of 200 g/m$^2$ was employed and a line image having a width of 0.3 mm and a length of 150 mm was formed in the direction the same as the progressing direction of the paper.

A: Both of the offset image on the white paper and the toner contamination on the heating roller were entirely not observed.

B: Though any offset image on the white paper is not confirmed, the toner contamination of the heating roller was observed.

C: The offset image was confirmed on the white paper.

The evaluation ranks A and B was acceptable and rank C was unacceptable for practical use.

<Occurrence of Jamming by Winding>

After printing of 100,000 sheets of image, the line speed was changed from 420 mm/sec to 840 mm/sec while the temperature of the heating roller was maintained at 165° C., and the image formation was performed to evaluate the winding of the paper.

A: Any jamming caused by fault of separation from the fixing roller and any mark of the claw were not observed.

B: Though any jamming by fault of the separation from the fixing roller did not occur, the claw marks were observed some degree (no problem in the practical use).

C: The jamming by winding occurred (problems occurred in the practical use).

<Filming on the Photoreceptor>

The surface of the photoreceptor was visually observed after printing of 500,000 sheets to judge the presence of the filming.

<Uniformity of the Halftone Image

Degradation of the uniformity of the halftone image accompanied with the variation of the transferring ability caused by the occurrence of the filming was evaluated. The norm of the evaluation was as follows.

A: Them image was uniform without unevenness.

B: Line-shaped weak unevenness was observed.

C: Certain unevenness lines were confirmed.

D: Presence of 5 or more obvious unevenness lines was confirmed.

Evaluation results are listed in FIGS. 4 and 5.

TABLE 4

(Evaluation results under LL condition)

| | | Transfer ability | | | | | | | Fixing ability | | Filming on photoreceptor | |
|---|---|---|---|---|---|---|---|---|---|---|---|---|
| | | Color difference | | | Fine line reproducibility | | Image scattering | | | | | |
| | Developer set No. | Red | Green | Blue | Initial print | 100,000th print | Initial print | 100,000th print | Anti-offset ability | Winding | Formation of filming | Uniformity of halftone image |
| Example 1 | Developer set 1 | 2 | 2 | 2 | 8 lines | 7 lines | A | A | B | B | Not formed | B |
| Example 2 | Developer set 2 | 1 | 1 | 1 | 8 lines | 7 lines | A | A | A | A | Not formed | A |
| Example 3 | Developer set 3 | 1 | 1 | 1 | 8 lines | 8 lines | A | A | A | A | Not formed | A |
| Example 4 | Developer set 4 | 1 | 1 | 1 | 8 lines | 8 lines | A | A | A | A | Not formed | A |
| Example 5 | Developer set 5 | 1 | 1 | 1 | 8 lines | 8 lines | A | A | A | A | Not formed | A |
| Example 6 | Developer set 6 | 1 | 1 | 1 | 8 lines | 8 lines | A | A | A | A | Not formed | A |
| Example 7 | Developer set 7 | 1 | 1 | 1 | 8 lines | 7 lines | A | A | A | A | Not formed | A |
| Example 8 | Developer set 8 | 2 | 2 | 2 | 8 lines | 7 lines | A | A | B | B | Not formed | B |
| Example 9 | Developer set 9 | 1 | 1 | 1 | 8 lines | 8 lines | A | A | A | A | Not formed | A |
| Comparative example 1 | Comparative developer set 1 | 4 | 4 | 4 | 8 lines | 6 lines | A | B | B | B | Not formed | B |
| Comparative example 2 | Comparative developer set 2 | 4 | 4 | 4 | 8 lines | 6 lines | A | C | B | B | Not formed | B |
| Comparative example 3 | Comparative developer set 3 | 6 | 7 | 7 | 6 lines | 4 lines | C | D | C | C | Formed | D |
| Comparative example 4 | Comparative developer set 4 | 6 | 6 | 6 | 7 lines | 5 lines | B | C | C | B | Formed | C |

TABLE 5

(Evaluation results under HH condition)

| | | Transfer ability | | | | | | | Fixing ability | | Filming on photoreceptor | |
|---|---|---|---|---|---|---|---|---|---|---|---|---|
| | | Color difference | | | Fine line reproducibility | | Image scattering | | | | | |
| | Developer set No. | Red | Green | Blue | Initial print | 100,000th print | Initial print | 100,000th print | Anti-offset ability | Winding | Formation of filming | Uniformity of halftone image |
| Example 10 | Developer set 1 | 2 | 1 | 3 | 8 lines | 7 lines | A | B | B | B | Not formed | B |
| Example 11 | Developer set 2 | 2 | 1 | 1 | 8 lines | 7 lines | A | B | B | B | Not formed | B |
| Example 12 | Developer set 3 | 1 | 2 | 1 | 8 lines | 8 lines | A | A | A | A | Not formed | A |

TABLE 5-continued (Evaluation results under HH condition)

| | Developer set No. | Transfer ability: Color difference Red | Green | Blue | Fine line reproducibility: Initial print | 100,000th print | Image scattering: Initial print | 100,000th print | Fixing ability: Anti-offset ability | Winding | Filming on photoreceptor: Formation of filming | Uniformity of halftone image |
|---|---|---|---|---|---|---|---|---|---|---|---|---|
| Example 13 | Developer set 4 | 2 | 1 | 1 | 8 lines | 8 lines | A | A | A | A | Not formed | A |
| Example 14 | Developer set 5 | 1 | 1 | 1 | 8 lines | 8 lines | A | A | A | A | Not formed | A |
| Example 15 | Developer set 6 | 1 | 1 | 1 | 8 lines | 8 lines | A | A | A | A | Not formed | A |
| Example 16 | Developer set 7 | 1 | 2 | 1 | 8 lines | 7 lines | A | A | A | A | Not formed | A |
| Example 17 | Developer set 8 | 2 | 3 | 2 | 8 lines | 7 lines | A | B | B | B | Not formed | B |
| Example 18 | Developer set 9 | 1 | 1 | 1 | 8 lines | 8 lines | A | A | A | A | Not formed | A |
| Comparative example 5 | Comparative developer set 1 | 5 | 4 | 3 | 8 lines | 6 lines | A | C | B | B | Not formed | B |
| Comparative example 6 | Comparative developer set 2 | 4 | 5 | 4 | 8 lines | 6 lines | B | C | B | B | Not formed | C |
| Comparative example 7 | Comparative developer set 3 | 9 | 8 | 8 | 6 lines | 2 lines | C | D | C | C | Formed | D |
| Comparative example 8 | Comparative developer set 4 | 8 | 7 | 7 | 7 lines | 3 lines | C | D | C | B | Formed | C |

Experiment 2

Moreover, image formation experiments were carried out employing the foregoing developers and the image forming apparatus shown in FIG. 4.

The conditions of the transfer and the fixing were the same as those in Experiment 1. The results are shown in Tables 6 and 7.

TABLE 6

(Evaluation results under LL condition)

| | Developer set No. | Transfer ability: Color difference Red | Green | Blue | Fine line reproducibility: Initial print | 100,000th print | Image scattering: Initial print | 100,000th print | Fixing ability: Anti-offset ability | Winding | Filming on photoreceptor: Formation of filming | Uniformity of halftone image |
|---|---|---|---|---|---|---|---|---|---|---|---|---|
| Example 19 | Developer set 1 | 2 | 2 | 2 | 8 | 7 | A | B | B | A | Not formed | B |
| Example 20 | Developer set 2 | 1 | 1 | 1 | 8 | 8 | A | A | A | A | Not formed | A |
| Example 21 | Developer set 3 | 1 | 1 | 1 | 8 | 8 | A | A | A | A | Not formed | A |
| Example 22 | Developer set 4 | 1 | 1 | 1 | 8 | 8 | A | A | A | A | Not formed | A |
| Example 23 | Developer set 5 | 1 | 1 | 1 | 8 | 8 | A | A | A | A | Not formed | A |
| Example 24 | Developer set 6 | 1 | 1 | 1 | 8 | 8 | A | A | A | A | Not formed | A |
| Example 25 | Developer set 7 | 1 | 1 | 1 | 8 | 8 | A | A | B | A | Not formed | A |
| Example 26 | Developer set 8 | 2 | 1 | 2 | 8 | 7 | A | B | A | A | Not formed | B |

TABLE 6-continued (Evaluation results under LL condition)

| | Developer set No. | Transfer ability: Color difference Red | Green | Blue | Fine line reproducibility Initial print | 100,000th print | Image scattering Initial print | 100,000th print | Fixing ability: Anti-offset ability | Winding | Filming on photoreceptor: Formation of filming | Uniformity of halftone image |
|---|---|---|---|---|---|---|---|---|---|---|---|---|
| Example 27 | Developer set 9 | 2 | 1 | 2 | 8 | 7 | A | B | A | A | Not formed | A |
| Comparative example 9 | Comparative developer set 1 | 6 | 5 | 5 | 7 | 4 | B | C | B | C | Not formed | C |
| Comparative example 10 | Comparative developer set 2 | 5 | 6 | 6 | 7 | 4 | B | C | C | C | Not formed | C |
| Comparative example 11 | Comparative developer set 3 | 7 | 7 | 7 | 7 | 3 | C | D | C | C | Formed | D |
| Comparative example 12 | Comparative developer set 4 | 6 | 7 | 7 | 7 | 3 | B | D | C | C | Formed | D |

TABLE 7

(Evaluation results under HH condition)

| | Developer set No. | Transfer ability: Color difference Red | Green | Blue | Fine line reproducibility Initial print | 100,000th print | Image scattering Initial print | 100,000th print | Fixing ability: Anti-offset ability | Winding | Filming on photoreceptor: Formation of filming | Uniformity of halftone image |
|---|---|---|---|---|---|---|---|---|---|---|---|---|
| Example 28 | Developer set 1 | 2 | 3 | 2 | 8 lines | 7 lines | A | B | B | B | Not formed | B |
| Example 29 | Developer set 2 | 2 | 1 | 2 | 8 lines | 7 lines | A | B | B | B | Not formed | B |
| Example 30 | Developer set 3 | 1 | 1 | 2 | 8 lines | 8 lines | A | A | A | A | Not formed | A |
| Example 31 | Developer set 4 | 1 | 2 | 1 | 8 lines | 8 lines | A | A | A | A | Not formed | A |
| Example 32 | Developer set 5 | 1 | 1 | 1 | 8 lines | 8 lines | A | A | A | A | Not formed | A |
| Example 33 | Developer set 6 | 1 | 1 | 1 | 8 lines | 8 lines | A | A | A | A | Not formed | A |
| Example 34 | Developer set 7 | 1 | 1 | 2 | 8 lines | 7 lines | A | A | A | A | Not formed | A |
| Example 35 | Developer set 8 | 2 | 3 | 2 | 8 lines | 7 lines | A | B | B | B | Not formed | B |
| Example 36 | Developer set 9 | 1 | 2 | 1 | 8 lines | 8 lines | A | A | A | A | Not formed | A |
| Comparative example 13 | Comparative developer set 1 | 4 | 3 | 3 | 8 lines | 6 lines | A | C | B | B | Not formed | B |
| Comparative example 14 | Comparative developer set 2 | 3 | 4 | 5 | 7 lines | 5 lines | B | C | C | B | Formed some degree | C |
| Comparative example 15 | Comparative developer set 3 | 9 | 9 | 9 | 6 lines | 2 lines | C | D | D | C | Formed | D |
| Comparative example 16 | Comparative developer set 4 | 7 | 8 | 7 | 6 lines | 3 lines | C | D | D | C | Formed | D |

By the use of the toner in which the dispersion state of the releasing agent phase is controlled so that the nearest wall distance of the releasing agent domains is within the specified range, the destroying of the toner particle caused by the releasing of the releasing agent from the toner particle by the vibration is prevented even when the image formation was carried out in the transfer process applying the ultrasonic vibration. Consequently, the occurrence of the jamming of the image receiving material caused by winding the image receiving material about the fixing roller and that of the offset are prevented and the image formation can be carried out in which the fixing is stably realized.

Moreover, it is found that the full color image having with high color reproducibility in which reach color toner images are correctly accumulated can be formed under applying variation since the releasing of the releasing agent from the toner by the ultrasonic vibration in the transfer process is avoided so as to prevent the deformation of the image.

What is claimed is:

1. An image forming method comprising: transferring a toner image while applying vibration by ultrasonic waves wherein the toner image comprises toner particles each having a sea-island structure containing at least two islands of a releasing agent, and the average of the nearest distance between the islands is from approximately 100 nm to approximately 1060 nm and the number of the islands having the nearest wall distance of not less than 1300 nm is not more than 10% of the whole number of the islands contained in the toner particle.

2. The image forming method of claim 1, wherein the average of the nearest wall distance between the islands in the toner particle is from 100 to 1060 nm.

3. The image forming method of claim 1, wherein the toner image is a toner image formed by accumulation of plural toner particles different from each other in the color thereof.

4. The image forming method of claim 3, wherein the plural color toner particles include yellow toner particles, cyan toner particles, magenta toner particles and black toner particles.

5. The image forming method of claim 3, wherein the transfer step is a step transferring the toner image to an intermediate transfer member.

6. The image forming method of claim 3, wherein the transfer step is a step transferring the toner image to a recording medium.

7. The image forming method of claim 6, wherein the average of nearest wall distance is from 260 to 820 nm and the number of the island having the nearest wall distance of not less than 1300 nm is not more than 4% of the whole number of the islands in the toner particles.

8. The image forming method of claim 3, wherein the frequency of the vibration by the ultrasonic wave is from 40 kHz to 2 MHz.

9. The image forming method of claim 3, wherein the toner particles are obtained through a process for aggregating resin particles each containing the releasing agent, and a colorant particle in an aqueous medium and the number average diameter of the toner particles is from 2 to 7 μm.

10. The image forming method of claim 1, wherein the transfer step is a step transferring the toner image to an intermediate transfer member.

11. The image forming method of claim 1, wherein the transfer step is a step transferring the toner image to a recording medium.

12. The image forming method of claim 1, wherein the toner particles are obtained through a process for aggregating resin particles each containing the releasing agent, and a colorant particle in an aqueous medium and the number average diameter of the toner particles is from 2 to 7 μm.

13. The image forming method of claim 11, wherein the average of nearest wall distance is from 260 to 820 nm and the number of the island having the nearest wall distance of not less than 1300 nm is not more than 4% of the whole number of the islands in the toner particles.

14. The image forming method of claim 1, wherein the average of nearest wall distance is from 260 to 820 nm and the number of the island having the nearest wall distance of not less than 1300 nm is not more than 4% of the whole number of the islands in the toner particles.

15. The image forming method of claim 14, wherein the number average diameter of the toner particles is from 2 to 7 μm.

16. The image forming method of claim 15, wherein the frequency of the vibration by the ultrasonic wave is from 40 kHz to 2 MHz.

17. The image forming method of claim 16, wherein the releasing agent contains a compound represented by the following formula, $$R_1—(OCO—R_2)_n$$

wherein n is an integer of from 1 to 4; and $R_1$ and $R_2$ are each a hydrocarbon group which may have a substituent.

18. The image forming method of claim 1, wherein the number average diameter of the toner particles is from 3.5 to 4.0 μm.

19. The image forming method of claim 1, wherein the frequency of the vibration by the ultrasonic wave is from 40 to kHz to 2 MHz.

20. The image forming method of claim 1, wherein the releasing agent contains a compound represented by the following formula, $$R_1—(OCO—R_2)_n$$

wherein n is an integer of from 1 to 4; and $R_1$ and $R_2$ are each a hydrocarbon group which may have a substituent.

* * * * *